US006834943B2

(12) United States Patent
Mihara et al.

(10) Patent No.: US 6,834,943 B2
(45) Date of Patent: Dec. 28, 2004

(54) LIQUID DISCHARGE HEAD, A SUBSTRATE FOR USE OF SUCH HEAD AND A METHOD OF MANUFACTURE THEREFOR

(75) Inventors: Hiroaki Mihara, Tokyo (JP); Masahiko Ogawa, Tokyo (JP); Kazuaki Masuda, Kawasaki (JP); Masami Ikeda, Tokyo (JP); Ichiro Saito, Yokohama (JP); Hiroyuki Ishinaga, Tokyo (JP); Toshio Kashino, Chigasaki (JP); Shuji Koyama, Kawasaki (JP); Tomoyuki Hiroki, Zama (JP); Yoshiyuki Imanaka, Kawasaki (JP); Teruo Ozaki, Yokohama (JP); Masahiko Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/071,799

(22) Filed: Feb. 11, 2002

(65) Prior Publication Data

US 2002/0093553 A1 Jul. 18, 2002

Related U.S. Application Data

(62) Division of application No. 09/128,538, filed on Aug. 4, 1998, now Pat. No. 6,374,482.

(30) Foreign Application Priority Data

Aug. 5, 1997 (JP) ..... 9-210831
Dec. 5, 1997 (JP) ..... 9-336060

(51) Int. Cl.[7] ..... B41J 2/05

(52) U.S. Cl. ..... 347/65; 347/67; 347/56

(58) Field of Search ..... 347/20, 56, 61, 347/63, 65, 67, 92, 94

(56) References Cited

U.S. PATENT DOCUMENTS

| | | | | |
|---|---|---|---|---|
| 4,611,219 | A | 9/1986 | Sugitani et al. | 347/40 |
| 4,860,033 | A | 8/1989 | Shiozaki et al. | 347/64 |
| 4,881,318 | A | 11/1989 | Komuro et al. | 29/827 |
| 4,994,825 | A | 2/1991 | Saito et al. | 347/63 |
| 5,081,474 | A | 1/1992 | Shibata et al. | 347/59 |

(List continued on next page.)

FOREIGN PATENT DOCUMENTS

| | | | |
|---|---|---|---|
| EP | 197652 | 8/1988 | |
| EP | 199972 | 8/1988 | |
| EP | 0737582 | 10/1996 | |
| GB | 2306399 | 5/1997 | |
| JP | 59911 | 12/1986 | |
| JP | 59914 | 12/1986 | |
| JP | 5-124189 | 5/1993 | 347/65 |
| JP | 9-201966 | 9/1997 | |

OTHER PUBLICATIONS

Wolf, Stanley, Silicon Processing for the VLSI ERA, vol. 1: Process Technology, Lattice Press, 1986, pp. 189–195.
Wolf, Stanley, Silicon Processing for the VLSI ERA, vol. 2: Process Integration, Lattice Press, 1990, pp. 104–105, 195–196.

*Primary Examiner*—Juanita D. Stephens
(74) *Attorney, Agent, or Firm*—Fitzpatrick, Cella, Harper & Scinto

(57) ABSTRACT

A liquid discharge head is provided with discharge ports for discharging liquid, liquid flow paths communicated with the discharge ports for supplying liquid to the discharge ports, a substrate having heat generating members for creating bubbles in the liquid, and movable members facing the heat generating members and being arranged in the liquid flow paths. The movable members have a free end on the discharge port side with a specific gap with respect to the heat generating members. The movable member is fixed to the substrate above the heat generating member on the substrate.

11 Claims, 21 Drawing Sheets

U.S. PATENT DOCUMENTS

| | | | | | |
|---|---|---|---|---|---|
| 5,135,605 | A | | 8/1992 | Blonder et al. | 216/97 |
| 5,208,604 | A | | 5/1993 | Watanabe et al. | 347/47 |
| 5,262,000 | A | | 11/1993 | Welbourn et al. | 29/622 |
| 5,278,585 | A | * | 1/1994 | Karz et al. | 347/65 |
| 5,479,197 | A | | 12/1995 | Fujikawa et al. | 347/63 |
| 5,872,582 | A | | 2/1999 | Pan | 347/65 |
| 6,007,187 | A | | 12/1999 | Kashino et al. | 347/65 |
| 6,074,543 | A | * | 6/2000 | Yoshihira et al. | 347/65 |
| 6,095,640 | A | * | 8/2000 | Ishinaga et al. | 347/65 |
| 6,109,735 | A | | 8/2000 | Kashino et al. | 347/65 |
| 6,113,224 | A | | 9/2000 | Sugama et al. | 347/65 |
| 6,164,763 | A | | 12/2000 | Sugama et al. | 347/63 |
| 6,183,068 | B1 | | 2/2001 | Kashino et al. | 347/65 |
| 6,213,592 | B1 | | 4/2001 | Takenouchi et al. | 347/65 |
| 6,273,556 | B1 | | 8/2001 | Ishinaga et al. | 347/65 |
| 6,305,789 | B1 | | 10/2001 | Nakata et al. | 347/61 |
| 6,312,111 | B1 | | 11/2001 | Kimura et al. | 347/65 |
| 6,318,848 | B1 | | 11/2001 | Iwasaki et al. | 347/65 |
| 6,331,050 | B1 | | 12/2001 | Nakata et al. | 347/65 |
| 6,334,669 | B1 | | 1/2002 | Kudo et al. | 347/65 |
| 6,485,132 | B1 | * | 11/2002 | Hiroki et al. | 347/65 |

* cited by examiner

LIQUID DISCHARGE HEAD, A SUBSTRATE FOR USE OF SUCH HEAD AND A METHOD OF MANUFACTURE THEREFOR

This application is a divisional of application Ser. No. 09/128,538, filed on Aug. 4, 1998 now U.S. Pat. No. 6,374,482.

BACKGROUND OF THE INVENTION

1. Field of the Invention

The present invention relates to a liquid discharge head that discharges a desired liquid by the creation of bubbles by the application of thermal energy that acts upon the liquid, and the method of manufacture therefor. More particularly, the invention relates to a liquid discharge head provided with a movable member which is displaceable by the utilization of created bubbles, and to the method of manufacture therefor as well. In this respect, the term "recording" in the description of the present invention means not only the provision of images having characters, graphics, or other meaningful representation on a recording medium, but also, the provision of those images that do not present any particular meaning, such as patterns, on it.

2. Related Background Art

There has been known the so-called bubble jet recording method, which is an ink jet recording method whereby to form images on a recording medium by discharging ink from discharge ports using acting force exerted by the change of states of ink accompanied by the abrupt voluminal changes (creation of bubbles), and to form images on a recording medium by the discharged ink that adheres to it. For the recording apparatus that uses the bubble jet recording method, it is generally practiced to provide, as disclosed in the specifications of Japanese Patent Publication No. 61-59911 and Japanese Patent Publication No. 61-59914, the discharge ports that discharge ink, the ink paths conductively connected to the discharge ports, and heat generating members (electrothermal converting means) arranged in each of the ink paths as means for generating energy for discharging ink.

In accordance with such recording method, it is possible to record high quality images at high speeds with a lesser amount of noises. At the same time, the head that executes this recording method makes it possible to arrange the discharge ports for discharging ink in high density, with the excellent advantage, among many others, that images are made recordable in high resolution, and that color images are easily obtainable by use of a smaller apparatus. In recent years, therefore, the bubble jet recording method is widely utilized for office equipment, such as a printer, a copying machine, a facsimile equipment. Further, this method is utilized for an industrial system, such as a textile printing system.

Under the circumstances, some of the inventors hereof have made ardent studies, while giving attention again to the principle of liquid discharges, in order to provide a new liquid discharge method that utilizes bubbles, as well as a head and others used for such method that has not been obtainable in accordance with the conventional art, and have taken out a patent as applied in Japanese Patent Application No. 8-4892 and some others.

The patent disclosed in the Japanese Patent Application No. 8-4892 and some others is a technique to positively control bubbles by the arrangement of the positional relationship between the fulcrum and the free end of a movable member in a liquid flow path so as to make the relationship such that the free end is positioned on the discharge port side, namely, on the downstream side, and also, by the arrangement of the movable member to face a heat generating member or a bubble generating area.

With the above-mentioned newest liquid discharge head and others provided on the basis on the restudied discharge principle, it becomes possible to obtain the synergic effect of the created bubble and the movable member to be displaced thereby. As a result, liquid in the vicinity of the discharge port can be discharged efficiently to enhance the discharge efficiency significantly as compared with the conventional discharge methods and heads of bubble jet type.

In this respect, the conventional liquid discharge head is structured with the movable member and the base unit thereof formed as individual bodies, respectively, as described above. Then, the movable member is positioned to the elemental substrate. After that, the movable member is bonded to the base unit by the application of gold bonding or adhesive agent.

In recent years, the materialization of a more precise liquid discharge head has been in demand. To this end, it becomes necessary to make the interior of each liquid flow paths more precise.

However, since the movable member and the base unit thereof are formed individually for the liquid discharge head described above, there is a problem that it is difficult to implement making each of the liquid flow paths more precise due to the positional relationship between the movable member and the base unit thereof.

SUMMARY OF THE INVENTION

With a view to solving the problems of the conventional techniques as discussed above, the present invention is designed. It is an object of the invention to provide a method for manufacturing a liquid discharge head whereby to make the interior of each liquid flow path finer in higher precision.

In order to achieve the objects described above, the method for manufacturing liquid discharge heads of the present invention, which is provided with discharge ports for discharging liquid; liquid flow paths communicated with the discharge ports for supplying liquid to the discharge ports; a substrate having heat generating members for creating bubbles in liquid; and movable members facing the heat generating members, each being arranged in each liquid flow path, having the free end on the discharge port side with a specific gap with the heat generating member, comprises the steps of forming the boundary layer used for providing a gap between the movable member and the substrate above the heat generating member on the substrate; of laminating the movable member on the boundary layer so as to position the free end above the heat generating member, at the same time fixing the movable member on the substrate; and of forming the gap between the movable member and the heat generating member by use of the boundary layer.

Also, the liquid discharge head of the present invention comprises a plurality of discharge ports for discharging liquid; a plurality of liquid flow paths communicated with each of the discharge ports to supply liquid to each of the discharge ports; a substrate provided with heat generating members for creating bubbles in liquid; movable members arranged in the plural liquid flow paths, each having the free end on the discharge port side to face the heat generating member; and pedestal portions formed on the substrate for supporting the movable members. Then, the movable member has the property of being curved by heat, and the portion corresponding to the movable range is separated from the substrate by the application of heat.

Also, the liquid discharge head of the present invention comprises a plurality of discharge ports for discharging liquid; a plurality of liquid flow paths communicated with each of the discharge ports to supply liquid to each of the discharge ports; a substrate provided with heat generating members for creating bubbles in liquid; movable members arranged in the plural liquid flow paths, each having the free end on the discharge port side to face the heat generating member; and pedestal portions formed on the substrate for supporting the movable members. Then, the portion of the movable member corresponding to the movable range is separated from the substrate by means of the inner stress and the function of the releasable layer formed on the substrate.

Also, the liquid discharge head of the present invention comprises a plurality of discharge ports for discharging liquid; a plurality of liquid flow paths communicated with each of the discharge ports to supply liquid to each of the discharge ports; a substrate provided with heat generating members for creating bubbles in liquid; movable members arranged in the plural liquid flow paths, each having the free end on the discharge port side to face the heat generating member; and pedestal portions formed on the substrate for supporting the movable members. Then, the portion of the movable member corresponding to the movable range is provided with a recessed part on the portion adjacent to the pedestal portion.

Also, the liquid discharge head of the present invention comprises discharge ports for discharging liquid; liquid flow paths communicated with each of the discharge ports to supply liquid to each of the discharge ports; a substrate provided with heat generating members for creating bubbles in liquid; and movable members arranged in the plural liquid flow paths, each having the free end on the discharge port side to face the heat generating member, and the free end being positioned on the downstream of the area center of the heat generating member. Then, the movable member is formed either one of silicon nitride, diamond, amorphous carbon hydride, and silicon oxide, and being incorporated on the substrate.

With the structure as described above, the movable portion of the movable member is separated from the substrate after the formation of the movable member on the substrate. Then, the movable member is incorporated in the liquid discharge head. As a result, there is no need for the process to position the movable member to the substrate as the member that functions as a different body, hence implementing arranging each interior of many numbers of the liquid flow paths finer in higher precision.

In this respect, the terms "upstream" and "downstream" referred to in the description of the present invention are used as expression with respect to the flow direction of liquid from the supply source of liquid to the discharge port through the bubble generating area (or the movable member) or the structural direction thereof.

The term "downstream side" related to the bubble itself represents the portion of the bubble on the discharge port side, which mainly acts upon the discharge of droplet directly. More specifically, it means the downstream side of the above-mentioned flow direction or the structural direction with respect to the center of each bubble or the bubble that may be created on the area of the downstream side of the area center of a heat generating member.

The term "separation walls" referred to in the description of the present invention means, in a broader sense, the walls (which may include the movable member) which are provided to divide the bubble generating area and the area that is communicated with a discharge port directly on a broader sense, and this term means, in a narrower sense, those which divide the flow path that includes the bubble generating area and the liquid flow path which is communicated with the discharge port in order to prevent the mixture of liquids each residing in the respective areas.

Further, the term "the teeth of a comb" referred to in the description of the present invention means the configuration in which the fulcrum of the movable member is formed by a shareable member, and then, the front of the free end thereof is in a state of being released.

BRIEF DESCRIPTION OF THE DRAWINGS

FIG. 3A is a cross-sectional view taken in the liquid flow direction; and FIG. 3B is a sectionally perspective view.

FIG. 4A is a cross-sectional view taken in the liquid flow direction; and FIG. 4B is a sectionally perspective view.

FIG. 6A shows the structure before the movable member and the electrode layer is separated; and FIG. 6B shows the structure after the movable member is separated from the electrode layer.

FIG. 7A is a plane view; FIG. 7B is a cross-sectional view.

FIG. 8A is a plane view; FIG. 8B is a cross-sectional view.

FIG. 12A is a plan view; FIG. 12B is a cross-sectional view.

FIG. 15A shows the apparatus having a protection film to be described later; and FIG. 15B shows the apparatus which is not provided any protection film.

FIG. 18A is a cross-section view; and FIG. 18B is a partially broken perspective view.

DETAILED DESCRIPTION OF THE PREFERRED EMBODIMENTS

Before any specific embodiments of the present invention are described, the description will be made of the most fundamental structure capable of enhancing the discharge power and discharge efficiency by controlling the propagating direction of pressure generated by bubbles and the development direction of bubbles when liquid is discharged in accordance with the present invention.

Figure 1A:
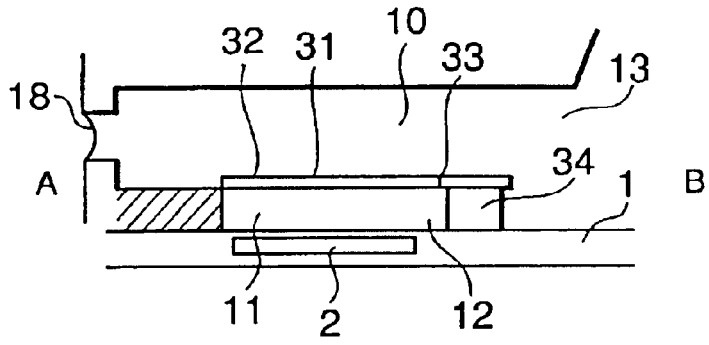
FIGS. 1A, 1B, 1C and 1D are views which illustrate the discharge principle of a liquid discharge head in accordance with the present invention.
Figure 1B:
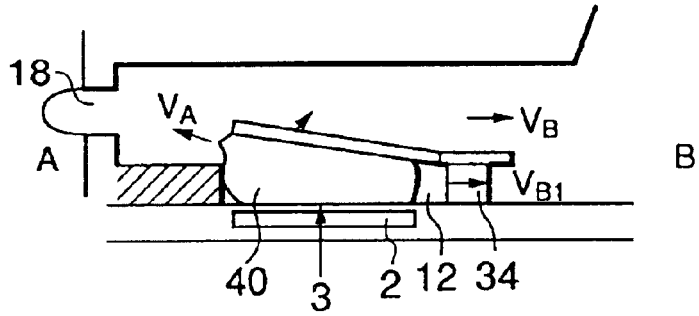
Figure 1C:
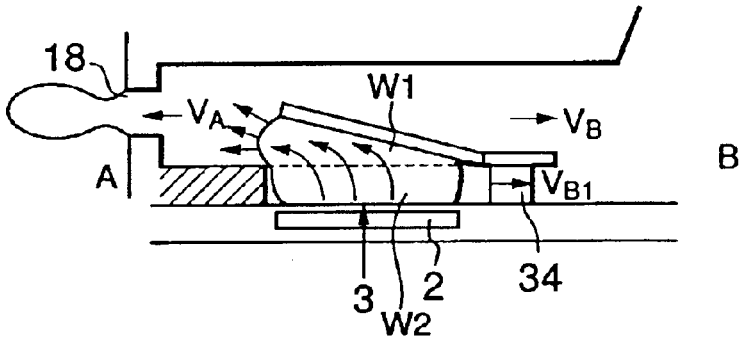
Figure 1D:
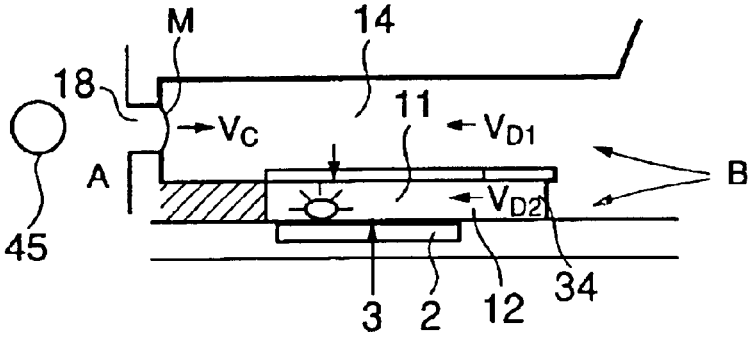
Figure 2:
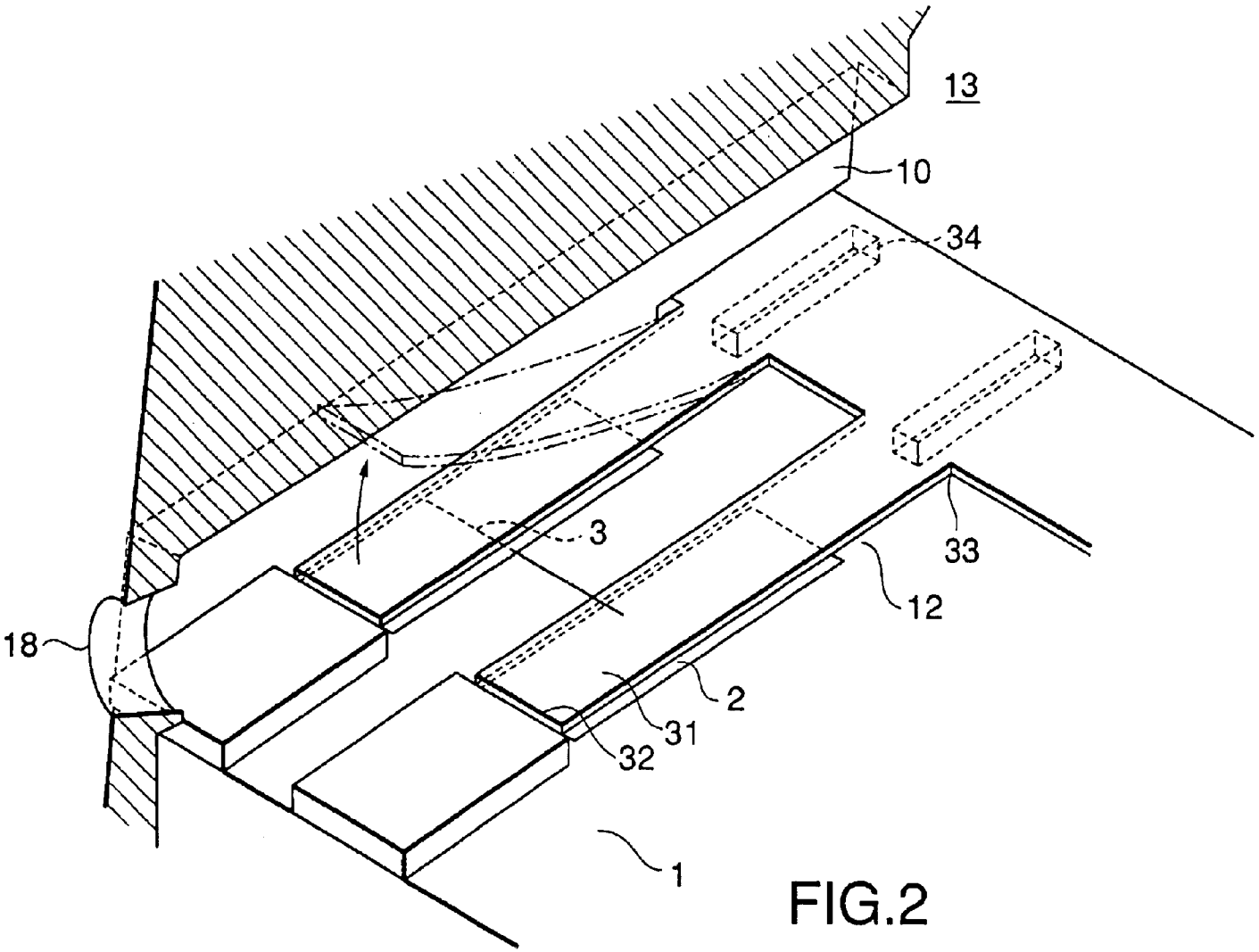
FIG. 2 is a partially broken perspective view which shows the liquid discharge head represented in FIGS. 1A to 1D.

FIGS. 1A to 1D are views which illustrate the discharge principle of a liquid discharge head in accordance with the present invention. Also, FIG. 2 is a partially broken perspective view which shows the liquid discharge head represented in FIGS. 1A to 1D.

In accordance with the example shown in FIGS. 1A to 1D, the liquid discharge head is provided with a heat generating member 2 (for the present example, a heat generating resistor in a shape of 40 $\mu$m×105 $\mu$m) that enables thermal energy to act upon liquid as a discharge energy generating device for discharging liquid, which is arranged on the elemental substrate 1. On the elemental substrate, the liquid flow path 10 is arranged corresponding to the heat generating member 2. At the same time that the liquid flow path 10 is communicated with the discharge port 18, it is communicated with a common liquid chamber 13 from which liquid is supplied to a plurality of liquid flow paths 10. Each of the liquid flow paths 10 receives liquid from the common liquid chamber 13 in an amount corresponding to the amount of the liquid that has been discharged from the discharge port 18. On the elemental substrate where the liquid flow path 10 is arranged, the plate type movable member 31 formed by elastic metal material or the like, which is provided with a plane portion, is arranged in a cantilever fashion so as to face the heat generating member 2 described earlier. One end of the movable member is fixed on the stand (supporting member) or the like formed by patterning a photosensitive resign or the like on the walls of the liquid flow path 10 or on the elemental substrate 1. In this manner, the movable member is supported, and at the same time, the fulcrum (fulcrum portion) 33 is arranged.

Also, with the movable member 31 being formed in a shape of teeth of a comb, it becomes possible to produce movable members 31 easily at lower costs. It also becomes easier to align each of them with the stand, respectively.

The movable member 31 is arranged in a position to face the heat generating member 2 with a gap of approximately 15 $\mu$m with the heat generating member 2 so as to cover it and provide the fulcrum (fulcrum portion: fixed end) 33 on the upstream side of a large flow running from the common liquid chamber 13 to the discharge port 18 side through the movable member 31 by the operation of liquid discharge, and the free end (free end portion) 32 on the downstream side with respect to this fulcrum 33. Between the heat generating member 2 and the movable member 31 is the bubble generating area 11.

When the heat generating member 2 is energized, heat acts upon liquid in the bubble generating area 11 between the movable member 31 and the heat generating member 2. Then, bubbles are created by means of the film boiling phenomenon disclosed in the specification of U.S Pat. No. 4,723,129. The pressure exerted by the creation of bubble, and the bubble thus created act upon the movable member priorly, and as shown in FIGS. 1B and 1C or FIG. 2, the movable member 31 is displaced to open it largely to the discharge port 18 side centering on the fulcrum 33. By the displacement or the displacing condition of the movable member 31, the propagation of the pressure exerted by the creation of bubble and the development of bubble itself are guided to the discharge port 18 side. Also, in this case, since the leading end portion of the free end 32 is wide, it becomes easier to guide the foaming power of the bubble to the discharge port 18 side, hence implementing the fundamental enhancement of the discharge efficiency, discharge speeds, and others.

Now, hereunder, with reference to the accompanying drawings, the description will be made of the embodiments in accordance with the present invention.

(First Embodiment)

Figure 3A:
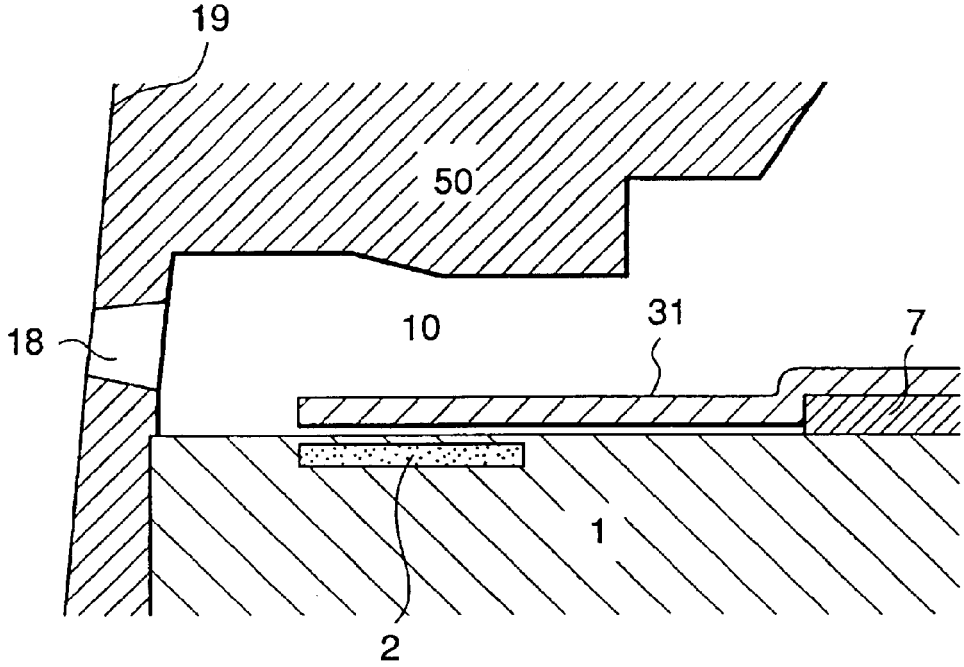
FIGS. 3A and 3B are views which illustrate the liquid discharge head manufactured by a method for manufacturing liquid discharge heads in accordance with another embodiment of the present invention.
Figure 3B:
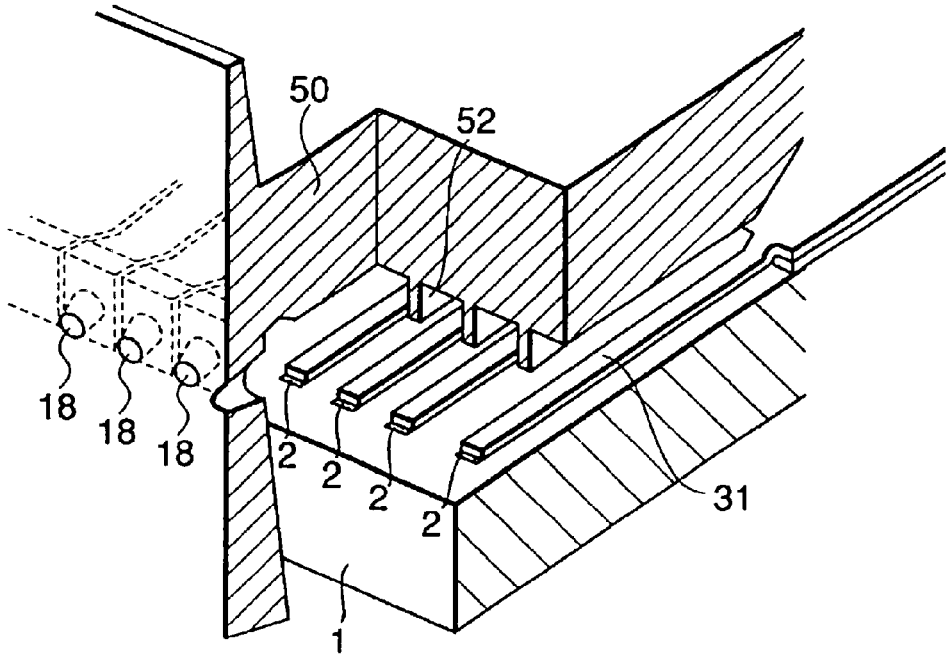

FIGS. 3A and 3B are views which illustrate the liquid discharge head manufactured by a method for manufacturing liquid discharge heads in accordance with another embodiment of the present invention: FIG. 3A is a cross-sectional view taken in the liquid flow direction; and FIG. 3B is a sectionally perspective view.

As shown in FIGS. 3A and 3B, the present embodiment comprises the heat generating member 2 that creates bubbles by the application of heat; the substrate 1 on which the heat generating members 2 are incorporated; the discharge ports 18 for discharging liquid; the orifice plate 19 having the discharge ports 18 formed therefor to determine the discharge direction of liquid; liquid flow paths 10 for supplying the discharge liquid to each of the discharge ports 18; the grooved member 50 that forms each of the liquid flow paths 10, the movable member 31 displaceable along the creation of bubbles on each of the heat generating members 2; and the pedestal portions 7 that supports the movable members 31, respectively. Here, the groove walls 52 that separate a plurality of liquid flow paths 10 from each other are arranged to extend in the direction toward the orifice plate 19, and formed integrally with the orifice plate 19.

Figure 4A:
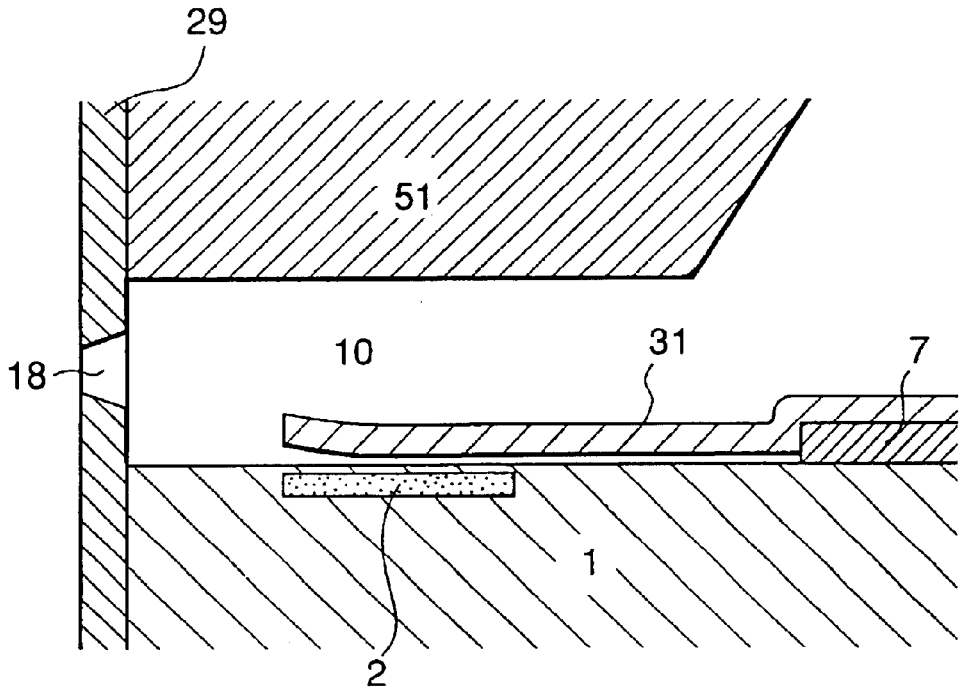
FIGS. 4A and 4B are views which illustrate the liquid discharge head manufactured by the method for manufacturing liquid discharge heads in accordance with still another embodiment of the present invention.
Figure 4B:
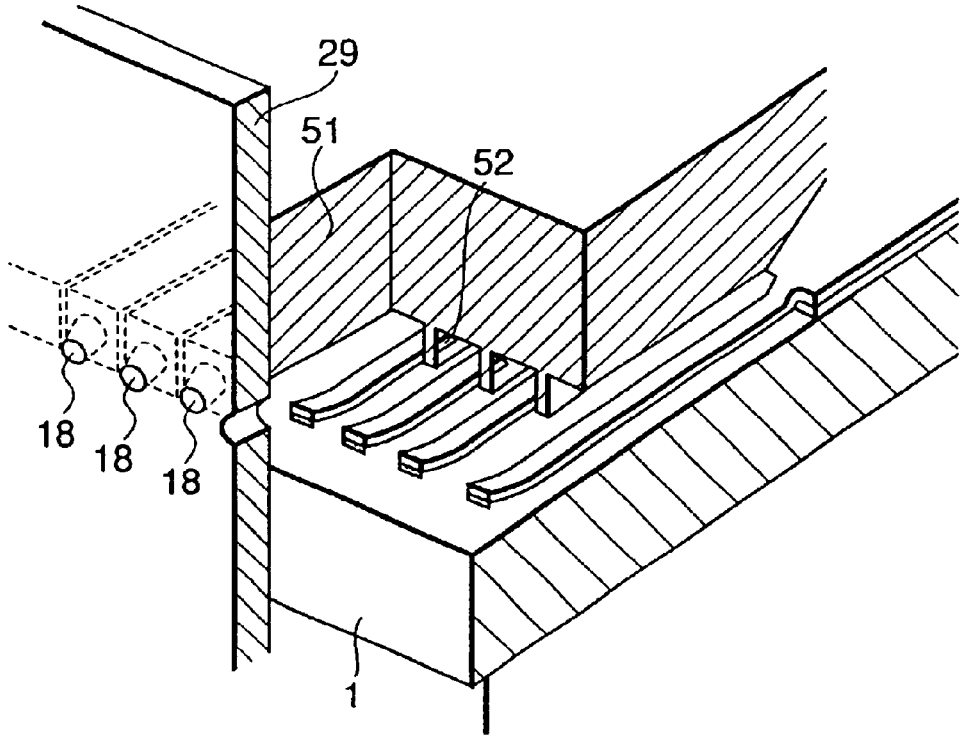

Also, FIGS. 4A and 4B are views which illustrate the liquid discharge head manufactured by the method for manufacturing liquid discharge heads in accordance with still another embodiment of the present invention: FIG. 4A is a cross-sectional view taken in the liquid flow direction; and FIG. 4B is a sectionally perspective view.

As shown in FIGS. 4A and 4B, the orifice plate 29 and the grooved member 51 are prepared as individual bodies in accordance with the present embodiment. Then, the groove walls 52 that separate the plural liquid flow paths 10 from each other are arranged to extend in the direction of the orifice plate 29, and bonded to the orifice plate 29 by use of a bonding agent or the like.

Now, the description will be made of the method of manufacture of the liquid discharge head structured as described above.

FIGS. 5A to 5J are views which illustrate the method for manufacturing the liquid discharge head represented in FIGS. 3A and 3B in accordance with a first embodiment of the present invention. The state of grooved film lamination is simplified for representation.

Figure 5A:
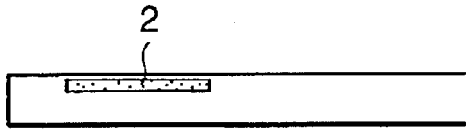
FIGS. 5A, 5B, 5C, 5D, 5E, 5F, 5G, 5H, 5I and 5J are views which illustrate the method for manufacturing liquid discharge heads represented in FIGS. 3A and 3B in accordance with a first embodiment of the present invention.
Figure 5B:
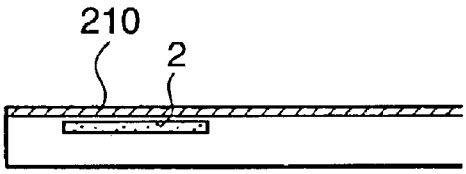

At first, on the surface of the substrate 1 having the heat generating member 2 arranged thereon (FIG. 5A), the electrode layer 210 formed by TiW layer or nickel layer is arranged by means of sputtering method or the like (FIG. 5B).

Figure 5C:
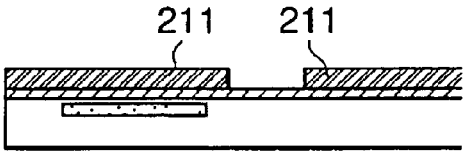

Then, the electrode layer 210 is coated by resist 211. After that, the resist 211 is patterned corresponding to the configuration of the pedestal portion 7 (FIG. 5C).

Figure 5D:
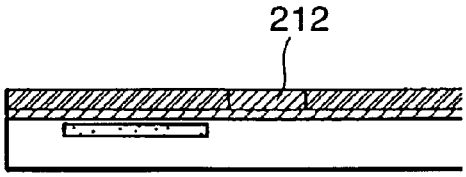

Then, using gold 212 the electroformation is conducted on the surface of the substrate. Here, since the resist 211 has been patterned on the surface of the substrate corresponding to the configuration of the pedestal portion 7, only the portion where the resist 211 has been removed by patterning is electroformed (FIG. 5D).

Figure 5E:
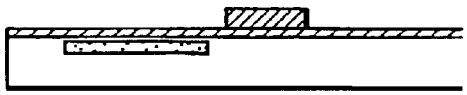

After that, the resist 211 is removed to make the pedestal portion 7 formed by gold 211 (FIG. 5E).

Figure 5F:
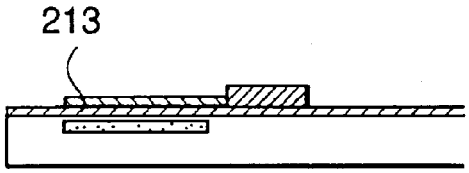

Then, on the area where the movable member 31 is arranged, the fusion (evaporation) material layer 213 is formed in order to separate the movable member 31 and the substrate 1 (FIG. 5F).

Figure 5G:
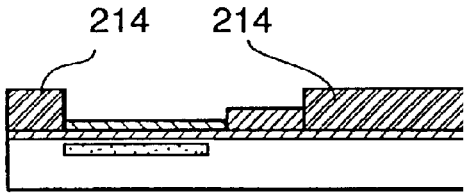

Subsequently, the surface of the substrate 1 is coated with resist 214. Then, the resist 214 is patterned corresponding to the configuration of the movable member 31 and the pedestal portion 7. In other words, the resist 214 on the area of the substrate 1 where the gold 212 and fusion material layer 213 are formed is removed (FIG. 5G).

Figure 5H:
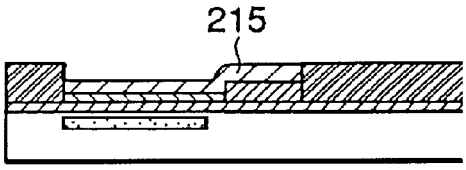

After that, nickel 215 is formed on the surface of the substrate. Here, since the resist 214 has been patterned corresponding to the configuration of the movable member 31 and the pedestal portion 7 on the surface of the substrate, the nickel 215 is formed only on the portion where the resist 214 is removed by patterning (FIG. 5H).

Figure 5I:
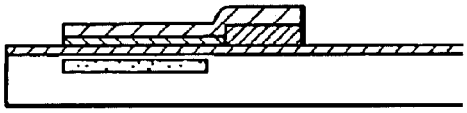

Then, the resist 214 is removed to form the movable member 31 provided with the supporting plate formed by nickel 215 (FIG. 5I).

Figure 5J:
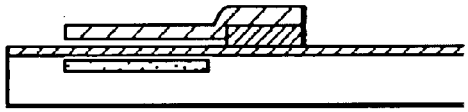

Subsequently, the fusion material layer 213 is fused by the application of heat so that it is evaporated, and that the movable member 31 and the electrode layer 210 are separated (FIG. 5J).

In this respect, if the uppermost layer of the surface of the substrate 1 is made electrode, there is no need for the production of the electrode layer 210.

Figure 6A:
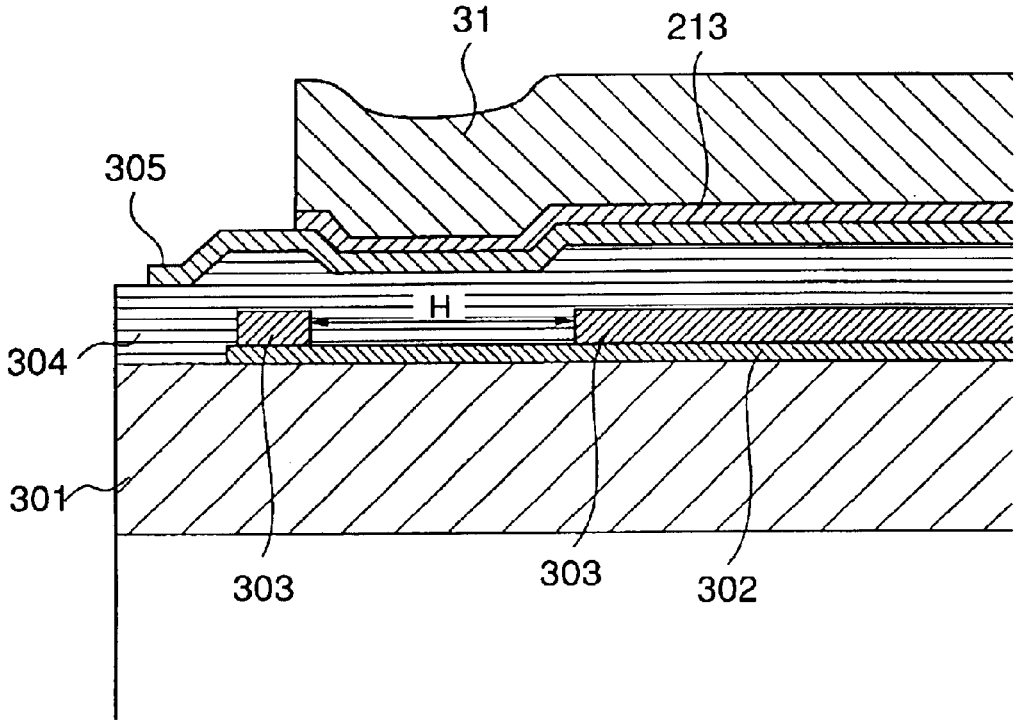
FIGS. 6A and 6B are cross-sectional views which illustrate the structure of the liquid discharge head manufactured by each of the processes represented in FIGS. 5A to 5J.
Figure 6B:
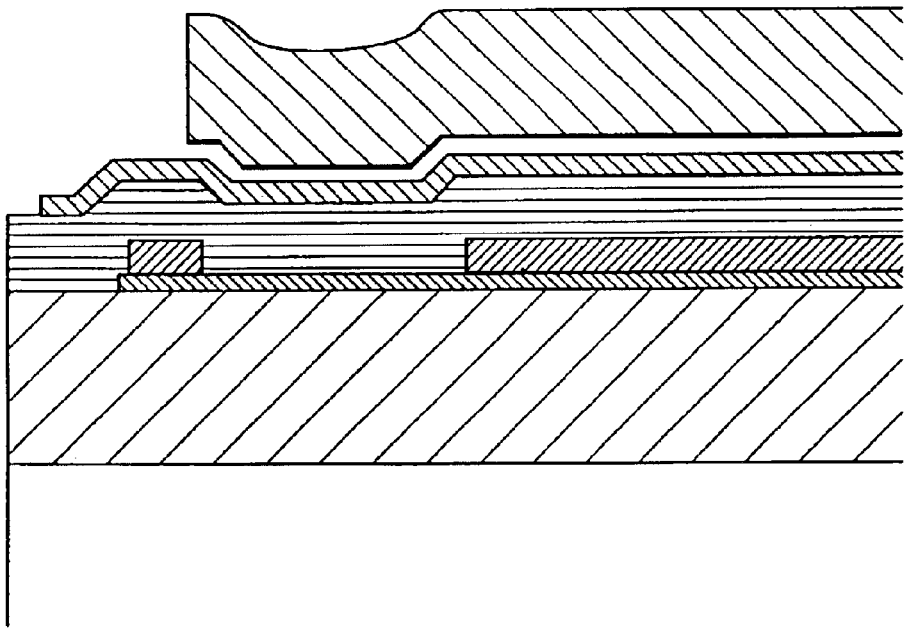

FIGS. 6A and 6B are cross-sectional views which illustrate the structure of the liquid discharge head manufactured by each of the processes represented in FIGS. 5A to 5J: FIG. 6A shows the structure before the movable member and the electrode layer is separated; and FIG. 6B shows the structure after the movable member is separated from the electrode layer.

As shown in FIGS. 6A and 6B, since there is no wiring layer 303 is formed on the area where the heat generating member 2 is arranged in accordance with the present embodiment, the thickness of the substrate is made slightly thinner than the portions surrounding such area. As a result, the movable member 31 in the vicinity of the heat generating member 2 is curved accordingly, hence making the discharge efficiency better still when liquid is discharged. Reference character H represents a heat generating portion.

Also, in order to intensify the close contact between the movable member 31 and the pedestal portion 7 more, it may be possible to form a hole on the movable member 31 for the provision of gold bonding.

Figure 7A:
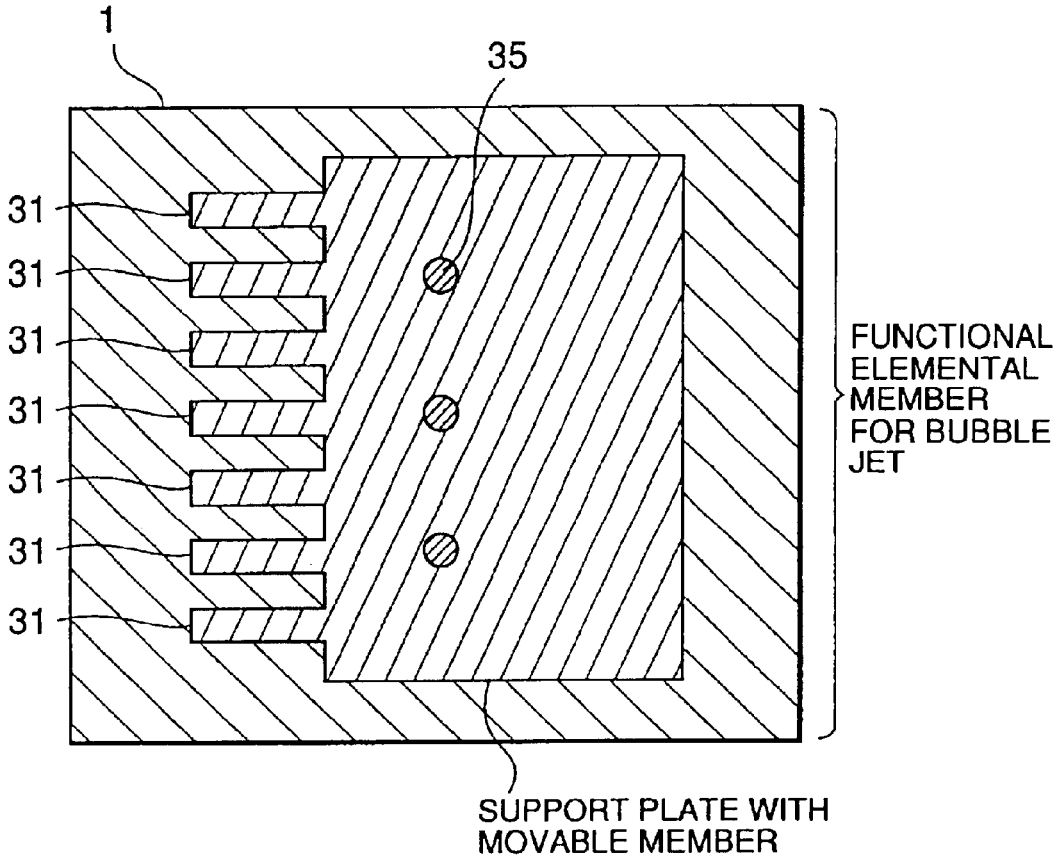
FIGS. 7A and 7B are views which illustrate the functional elemental member used for the bubble jet method advocated by Canon before bonding.
Figure 7B:
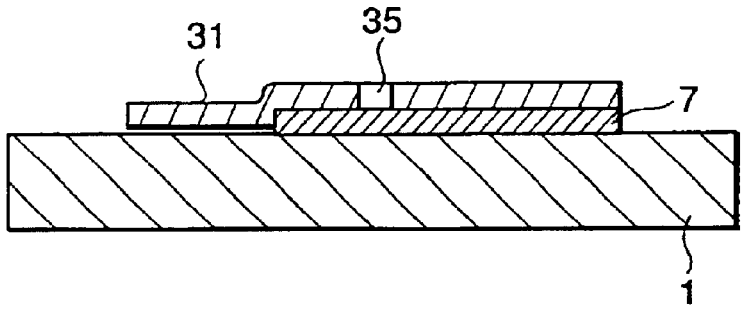
Figure 8A:
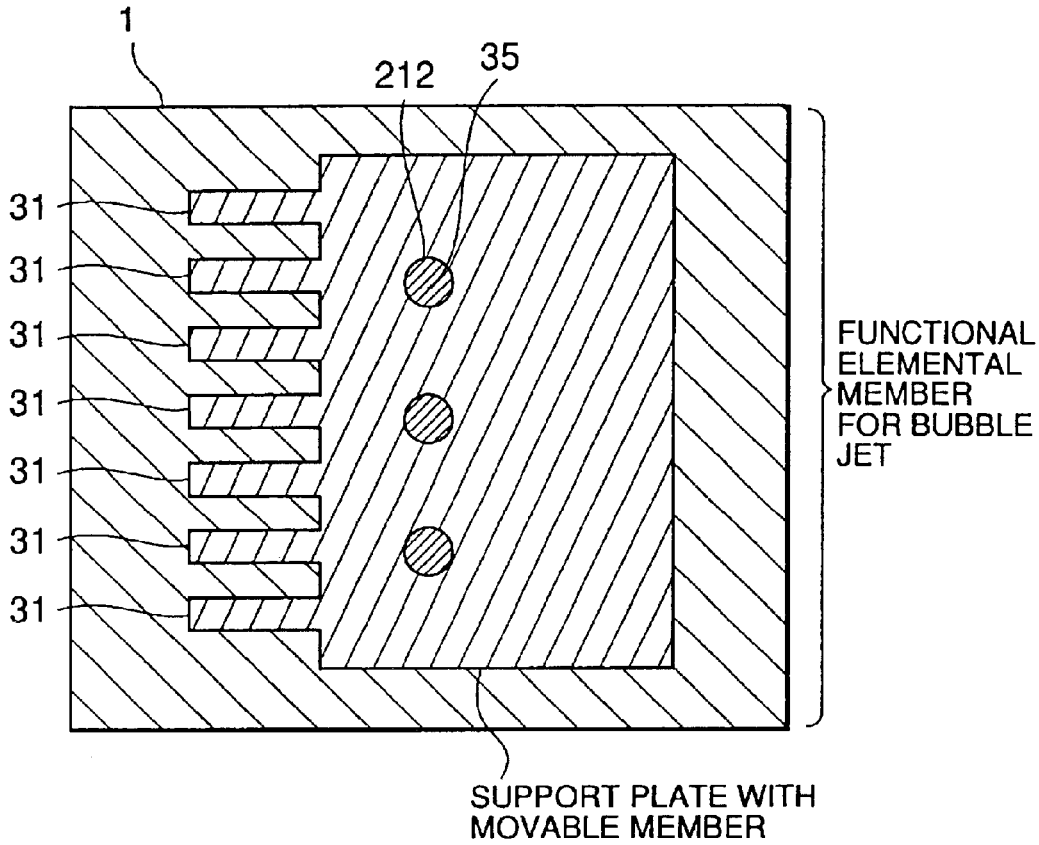
FIGS. 8A and 8B are views which illustrate the functional elemental member after bonding.
Figure 8B:
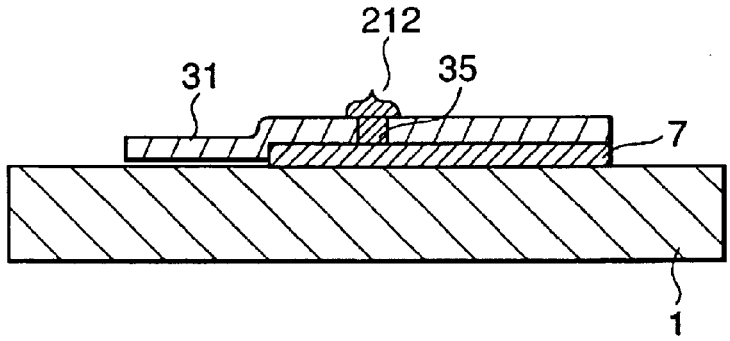

FIGS. 7A and 7B are views which illustrate the functional elemental member used for the bubble jet method advocated by Canon before bonding; FIG. 7A is a plane view; FIG. 7B is a cross-sectional view. FIGS. 8A and 8B are views which illustrate the functional elemental member after bonding; FIG. 8A is a plane view; FIG. 8B is a cross-sectional view.

As shown in FIGS. 7A and 7B and FIGS. 8A and 8B, bump holes 35 reaching the pedestal portion 7 are arranged on the movable member 31, and gold 212 is filled into the bump holes 35. In this manner, the movable member 31 and the pedestal portion 7 are bonded more strongly.

In this respect, nickel is used as the material of the movable member 31 in accordance with the present embodiment, but it may be possible to use gold or the like.

Also, as the material of the grooved member 50, there are named Si, polysulfone, or the like, and as the material of the orifice plate 29, nickel, polyimide, or the like.

After the movable members 31 and the pedestal portions 7 are formed on the substrate 1, the grooved member 50 is joined to the substrate 1 by the application of bonding agent or by use of spring.

Then, a liquid discharge head is completed through each processes of die bonding, TAB connection, incorporation of ink supply members, (bonding of the orifice plate), sealing, and (framing as required if plural heads are used, the incorporation of tank if the tank and head are formed together as one body, or the like).

Here, if the substrates 1 and the grooved members 50 are formed on an Si wafer, it may be possible to bond them in the form of the wafer, and then, cut them into a chip mode, respectively.

(Second Embodiment)

FIGS. 9A to 9J are views which illustrate a method for manufacturing the liquid discharge head represented in FIGS. 3A and 3B in accordance with a second embodiment of the present invention. The state of grooved film lamination is simplified.

Figure 9A:
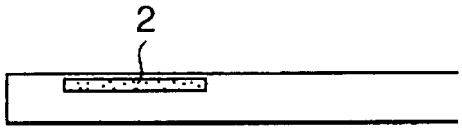
FIGS. 9A, 9B, 9C, 9D, 9E, 9F, 9G, 9H, 9I and 9J are views which illustrate a method for manufacturing the liquid discharge head represented in FIGS. 3A and 3B in accordance with a second embodiment of the present invention.
Figure 9B:
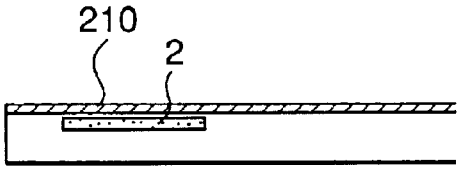

At first, on the surface of the substrate 1 having the heat generating member 2 arranged thereon (FIG. 9A), the electrode layer 210 formed by TiW layer or nickel layer is arranged by means of sputtering method or the like (FIG. 9B).

Figure 9C:
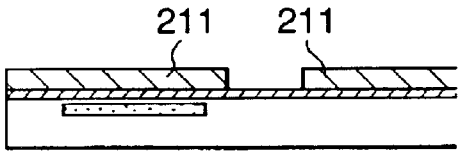

Then, the electrode layer 210 is coated by resist 211. After that, the resist 211 is patterned corresponding to the configuration of the pedestal portion 7 (FIG. 9C).

Figure 9D:
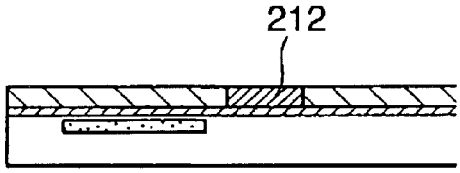

Then, using gold 212 the electroformation is conducted on the surface of the substrate. Here, since the resist 211 has been patterned on the surface of the substrate corresponding to the configuration of the pedestal portion 7, only the portion where the resist 211 has been removed by patterning is electroformed (FIG. 9D).

Figure 9E:
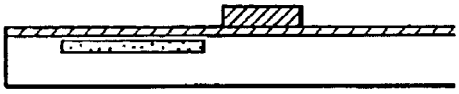

After that, the resist 211 is removed to make the pedestal portion 7 formed by gold 211 (FIG. 9E).

Figure 9F:
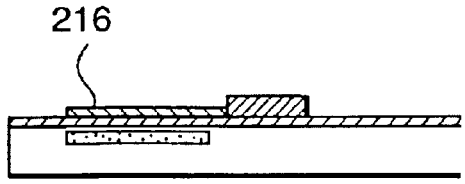

Then, on the area where the movable member 31 is arranged, the exfoliation layer 216 is formed in order to exfoliate the movable member 31 and the substrate 1 (FIG. 9F).

Figure 9G:
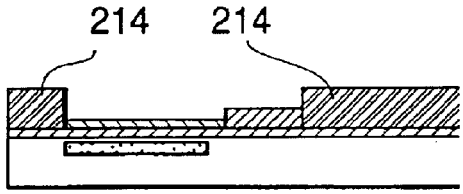

Subsequently, the surface of the substrate 1 is coated with resist 214. Then, the resist 214 is patterned corresponding to the configuration of the movable member 31 and the pedestal portion 7. In other words, the resist 214 on the area of the substrate 1 where the gold 212 and the exfoliation layer 216 are formed is removed (FIG. 9G).

Figure 9H:
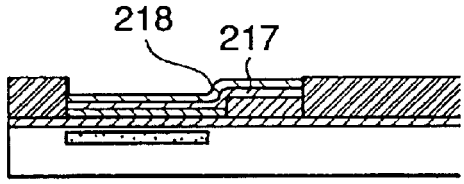

After that, the surface of the substrate is electroformed using a material 217 having a high thermal expansion coefficient and a material 218 having a lower thermal expansion coefficient. Here, since the resist 214 has been patterned corresponding to the configuration of the movable member 31 and the pedestal portion 7 on the surface of the substrate, only the portion where the resist 214 has been removed by patterning is electroformed (FIG. 9H).

Figure 9I:
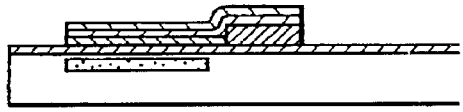

Then, the resist 214 is removed to form the movable member 31 provided with the supporting plate formed by the material 217 having the high thermal expansion coefficient and the material 218 having the low thermal expansion coefficient (FIG. 9I).

Figure 9J:
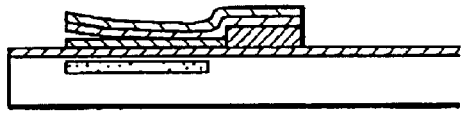

Subsequently, the material 217 having the high thermal expansion coefficient and the material 218 having the low thermal expansion coefficient are curved by the application of heat. In this way, the movable member 31 and the electrode layer 210 are exfoliated (FIG. 9J).

In this respect, if the uppermost layer of the surface of the substrate 1 is made electrode, there is no need for the production of the electrode layer 210.

In accordance with the present embodiment, the material 217 having the high thermal expansion coefficient and the material 218 having the low thermal expansion coefficient that form the movable member 31 are curved depending on the temperature in the nozzle. In this manner, the gap between the movable member 31 and the heat generating member 2 is regulated. As a result, the characteristic changes caused by the temperatures in the nozzle can be controlled by changing the thermal expansion coefficients of the two kinds of materials that form the movable member 31.

(Third Embodiment)

FIGS. 10A to 10J are views which illustrate a method for manufacturing the liquid discharge head represented in FIGS. 3A and 3B in accordance with a third embodiment of the present invention. The state of the grooved film lamination is simplified.

Figure 10A:
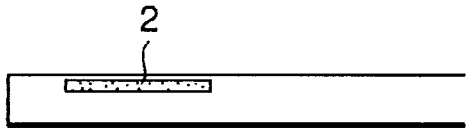
FIGS. 10A, 10B, 10C, 10D, 10E, 10F, 10G, 10H, 10I and 10J are views which illustrate a method for manufacturing the liquid discharge head represented in FIGS. 3A and 3B in accordance with a third embodiment of the present invention.
Figure 10B:
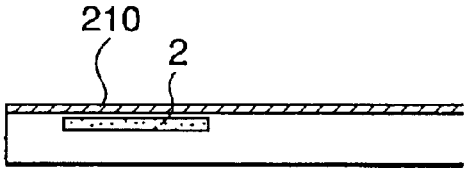

At first, on the surface of the substrate 1 having the heat generating member 2 arranged thereon (FIG. 10A), the electrode layer 210 formed by TiW layer or nickel layer is arranged by means of sputtering method or the like (FIG. 10B).

Figure 10C:
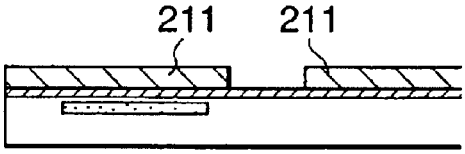

Then, the electrode layer 210 is coated by resist 211. After that, the resist 211 is patterned corresponding to the configuration of the pedestal portion 7 (FIG. 10C).

Figure 10D:
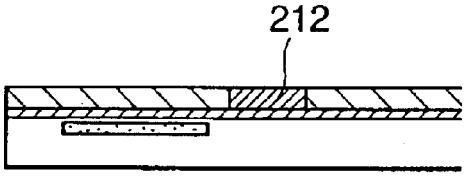

Then, using gold 212 the electroformation is conducted on the surface of the substrate. Here, since the resist 211 has been patterned on the surface of the substrate corresponding to the configuration of the pedestal portion 7, only the portion where the resist 211 has been removed by patterning is electroformed (FIG. 10D).

Figure 10E:
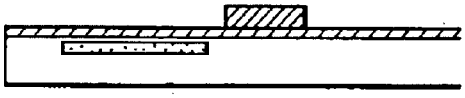

After that, the resist 211 is removed to make the pedestal portion 7 formed by gold 211 (FIG. 10E).

Figure 10F:
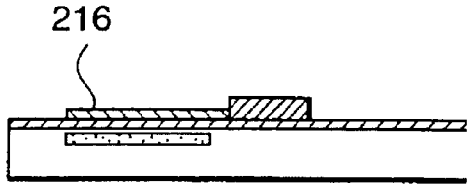

Then, on the area where the movable member 31 is arranged, the exfoliation layer 216 is formed in order to exfoliate the movable member 31 and the substrate 1 (FIG. 10F).

Figure 10G:
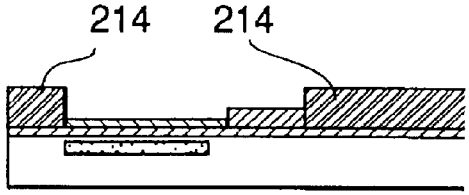

Subsequently, the surface of the substrate 1 is coated with resist 214. Then, the resist 214 is patterned corresponding to the configuration of the movable member 31 and the pedestal portion 7. In other words, the resist 214 on the area of the substrate 1 where the gold 212 and the exfoliation layer 216 are formed is removed (FIG. 10G).

Figure 10H:
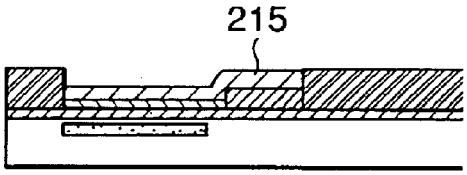

After that, the surface of the substrate is electroformed using nickel 215. Here, since the resist 214 has been patterned corresponding to the configuration of the movable member 31 and the pedestal portion 7 on the surface of the substrate, only the portion where the resist 214 has been removed by patterning is electroformed with nickel 215 (FIG. 10H). Also, in this case, the stress moderator contained in the electroforming solution is adjusted so that the inner stress of nickel becomes tensile stress.

Figure 10I:
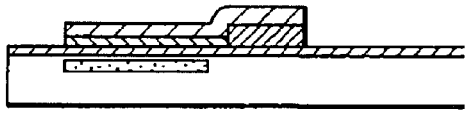
Figure 10J:
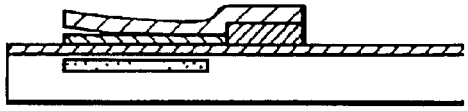

Then, the resist 214 is removed to form the movable member 31 provided with the supporting plate formed by nickel (FIG. 10I).

Subsequently, the movable member 31 and the electrode layer 210 are exfoliated by the function of the exfoliation layer 216 and by means of the inner stress of the movable member 31, the electrode layer 210 and the movable member 31 are exfoliated to complete the liquid discharge head.

In this respect, if the uppermost layer of the surface of the substrate 1 is made electrode, there is no need for the production of the electrode layer 210.

For the present embodiment, the movable member 31 has a property that its leading end is curved upward with the pedestal portion 7 as the fulcrum thereof after the electrode layer 210 is exfoliated. Therefore, it becomes possible to secure the liquid generating area stably, and also, to move the movable member 31 efficiently at the time of foaming.

(Fourth Embodiment)

Figure 11:
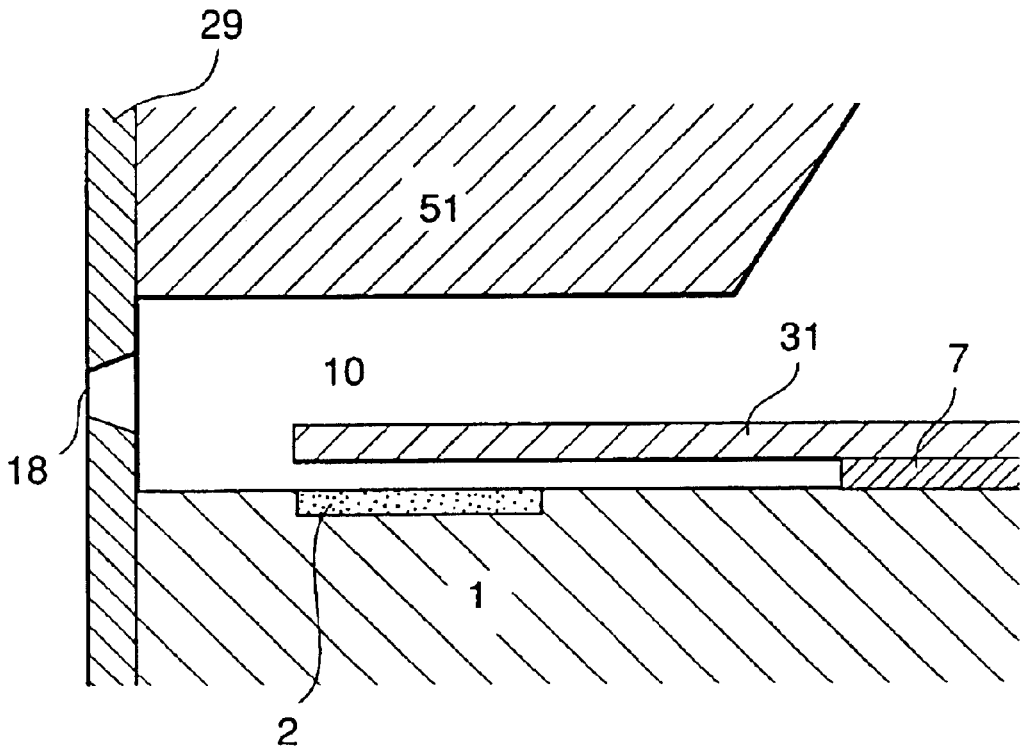
FIG. 11 is a cross-sectional view which shows a liquid discharge head manufactured by the method for manufacturing liquid discharge heads in accordance with another embodiment of the present invention, taken in the liquid flow path.

FIG. 11 is a cross-sectional view which shows a liquid discharge head manufactured by the method for manufacturing liquid discharge heads in accordance with another embodiment of the present invention, taken in the liquid flow path.

As shown in FIG. 11, the present embodiment comprises the heat generating member 2 that creates bubbles by the application of heat; the substrate 1 on which the heat generating members 2 are incorporated; the discharge ports 18 for discharging liquid; the orifice plate 19 having the discharge ports 18 formed therefor to determine the discharge direction of liquid; liquid flow paths 10 for supplying the discharge liquid to each of the discharge ports 18; the grooved member 51 that forms each of the liquid flow paths 10, the movable member 31 displaceable along the creation of bubbles on each of the heat generating members 2; and the pedestal portions 7 that support the movable members 31, respectively. Here, the groove walls 52 that separate a plurality of liquid flow paths 10 from each other are arranged to extend in the direction toward the orifice plate 19, and formed integrally with the orifice plate 19.

Now, hereunder, the description will be made of the method for manufacturing liquid discharge heads described above as a fourth embodiment in accordance with the present invention.

FIGS. 12A to 12I are views which illustrate the method for manufacturing the liquid discharge head represented in FIG. 11 in accordance with one embodiment of the present invention.

Figure 12A:
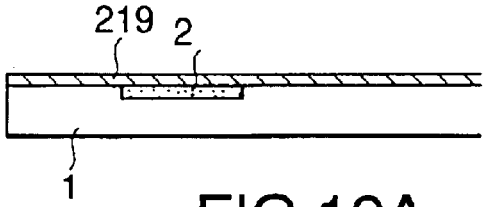
FIGS. 12A, 12B, 12C, 12D, 12E, 12F, 12G, 12H and 12I are views which illustrate the method for manufacturing the liquid discharge head represented in FIG. 11 in accordance with one embodiment of the present invention.
Figure 12B:
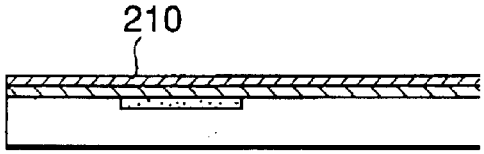

At first, on the surface of the substrate 1 having the heat generating member 2 arranged thereon, as well as the tantalum layer 219 thereon (FIG. 12A), the electrode layer 210 formed by TiW layer or the like is arranged by means of sputtering method or the like (FIG. 12B).

Figure 12C:
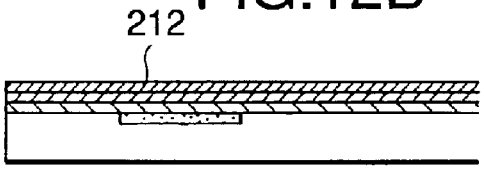

Then, gold 212 is formed on the surface of the electrode layer 210 by means of sputtering method or the like (FIG. 12C).

Figure 12D:
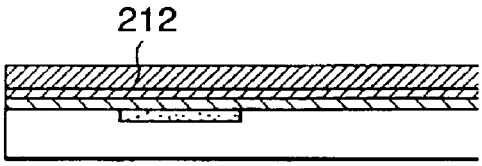

After that, gold 212 is further electroformed on the surface of the substrate (FIG. 12D). In this case, the thickness of gold 212 is 0.5 to 10 $\mu$m.

Figure 12E:
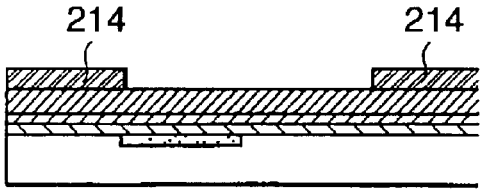

Then, the surface of the substrate 1 is coated with resist 214. Subsequently, the resist 214 is patterned corresponding to the configuration of the movable member 31 and the pedestal portion 7 (FIG. 12E).

Figure 12F:
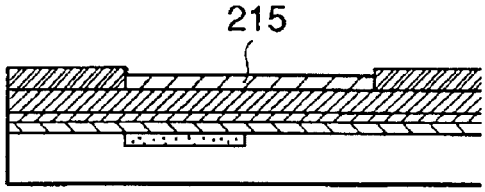

Then, using nickel 215 the surface of the substrate is electroformed. Here, since the resist 214 has been patterned on the surface of the substrate corresponding to the configuration of the movable member 31 and the pedestal portion 7, nickel is electroformed only the portion where the resist 214 has been removed by patterning (FIG. 12F). In this respect, the thickness of nickel 215 is 0.5 to 10 $\mu$m.

Figure 12G:
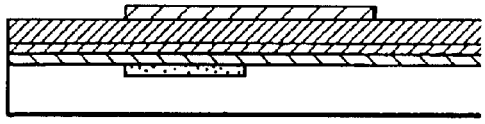

After that, the remaining resist 214 is removed (FIG. 12G).

Figure 12H:
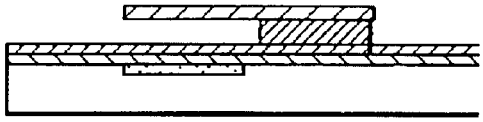

Then, gold 212 is removed by means of wet etching using potassium cyanide. In this case, the etching is terminated when all the gold has been removed by overetching under the movable portion of the movable member 31 (FIG. 12H).

Figure 12I:
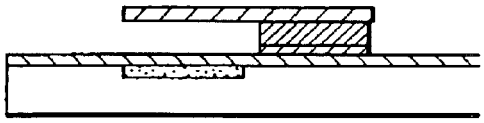

Subsequently, the electrode layer 210 is removed by means of etching using hydrogen peroxide (FIG. 12I).

Figure 13A:
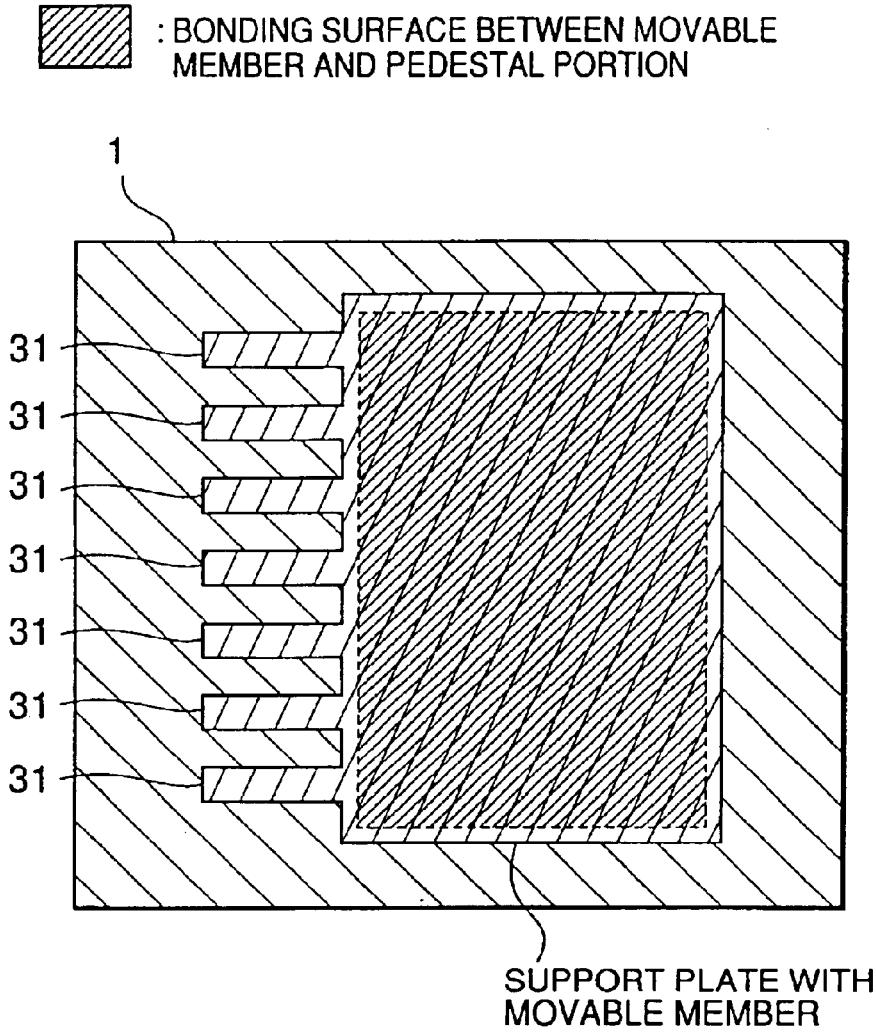
FIGS. 13A and 13B are views which illustrate the structure of the liquid discharge head manufactured by each of the processes represented in FIGS. 12A to 12I.
Figure 13B:
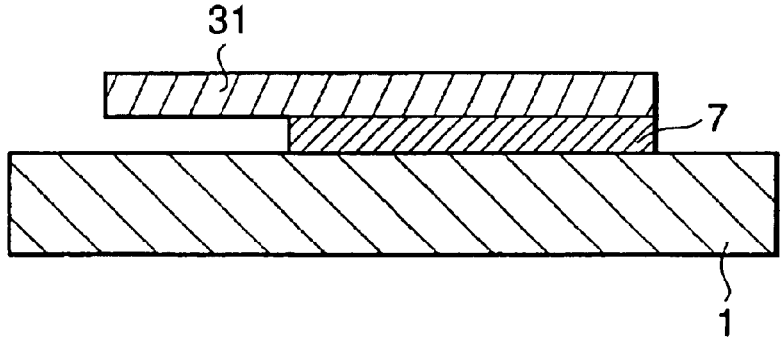

With the series of processes described above, a liquid discharge head is completed as shown in FIGS. 13A and 13B.

FIGS. 13A and 13B are views which illustrate the structure of the liquid discharge head manufactured by each of the processes represented in FIGS. 12A to 12I; FIG. 12A is a plan view; FIG. 12B is a cross-sectional view.

In this respect, if the tantalum layer 219 which serves as the surface layer of the substrate 1 is made electrode, the formation step of the electrode layer 210 is not needed. Also, if the electroformation using gold is conducted directly on the tantalum layer 219 or the electrode layer 210, there is no need for the gold sputtering process, either.

As compared with the first embodiment, the present embodiment as described above makes it possible to control the gap between the movable member 31 and the heat generating member 2 more accurately by means of the pedestal portion 7.

(Fifth Embodiment)

FIGS. 14A to 14I are views which illustrate the method for manufacturing liquid discharge heads in accordance with a fourth embodiment of the present invention.

Figure 14A:
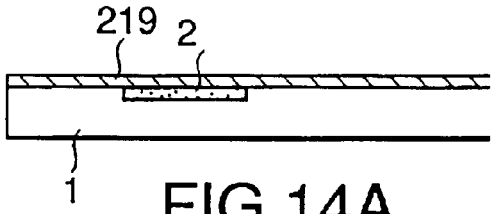
FIGS. 14A, 14B, 14C, 14D, 14E, 14F, 14G, 14H and 14I are views which illustrate the method for manufacturing the liquid discharge head represented in FIG. 11 in accordance with a fourth embodiment of the present invention.
Figure 14B:
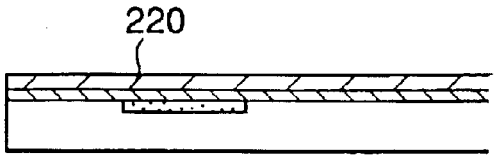

At first, on the surface of the substrate 1 having the heat generating member 2 arranged thereon, as well as the tantalum layer 219 thereon (FIG. 14A), lead 220 is formed by means of sputtering method or the like (FIG. 14B).

Figure 14C:
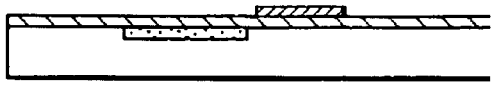

Then, with only the portion that becomes the pedestal of the movable member being left intact, lead 220 is removed by patterning (FIG. 14C).

Figure 14D:
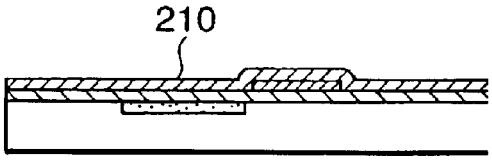

Subsequently, with TiW the electrode layer 210 is formed by means of sputtering method or the like on the surface of the substrate (FIG. 14D).

Figure 14E:
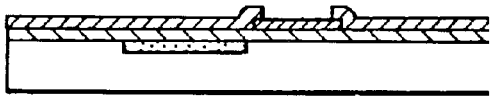

After that, the electrode 210 is patterned to remove the electrode layer 210 on the portion that becomes the pedestal of the movable member (FIG. 14E).

Figure 14F:
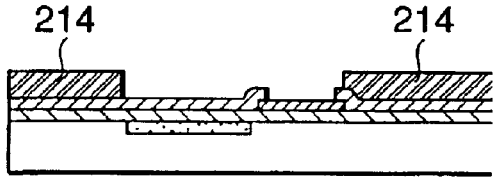

Then, the surface of the substrate 1 is coated with resist 214. Subsequently, the resist 214 is patterned corresponding to the configuration of the movable member and the pedestal portion (FIG. 14F).

Figure 14G:
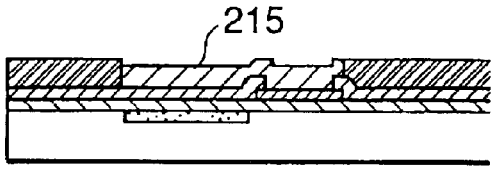

Then, using nickel 215 the surface of the substrate is electroformed. Here, since the resist 214 has been patterned on the surface of the substrate corresponding to the configuration of the movable member and the pedestal portion, nickel is electroformed only the portion where the resist 214 has been removed by patterning (FIG. 14G).

Figure 14H:
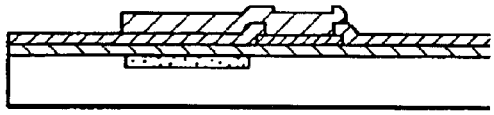

After that, the remaining resist 214 is removed (FIG. 14H).

Figure 14I:
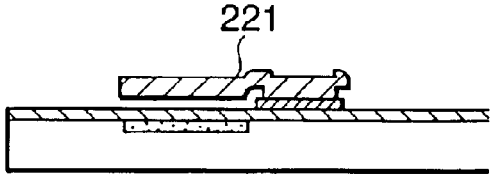

Then, the electrode layer 210 in the vicinity of the movable member is removed by means of etching (FIG. 14I).

With the series of processes described above, a liquid discharge head is completed. In accordance with the present embodiment, however, the recessed portion 221 is formed in the vicinity of the pedestal of the movable member. Therefore, the movable portion of the movable member is configured to be easily movable when liquid is discharged.

(Sixth Embodiment)

Figure 18A:
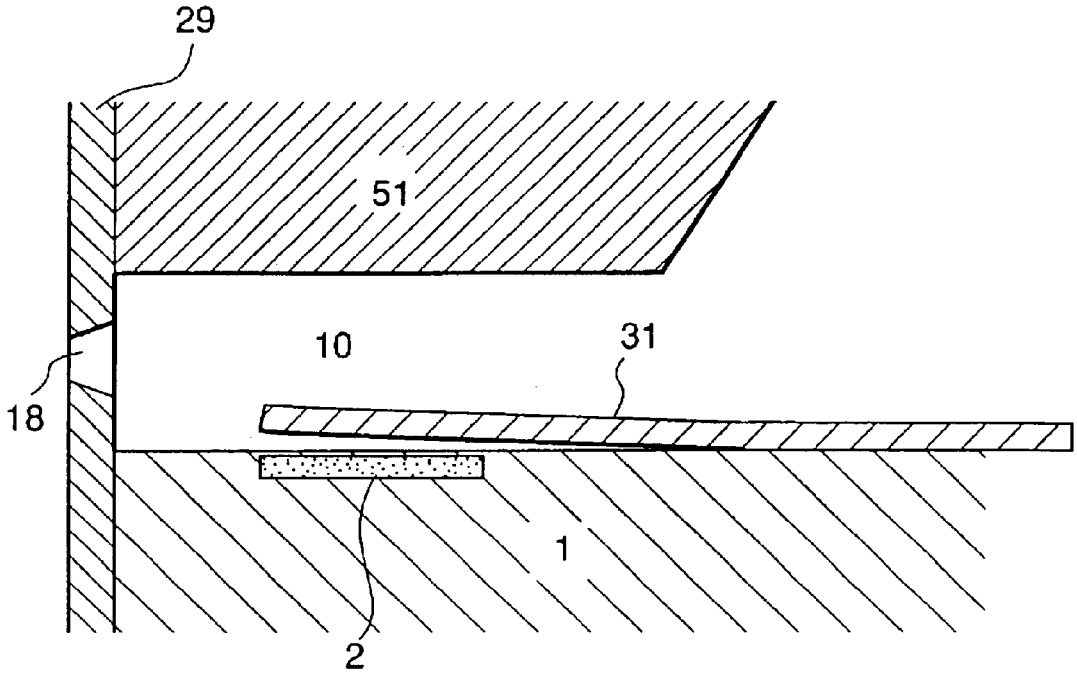
FIGS. 18A and 18B are views which illustrate the liquid discharge head manufactured by the method for manufacturing liquid discharge heads in accordance with one embodiment of the present invention.
Figure 18B:
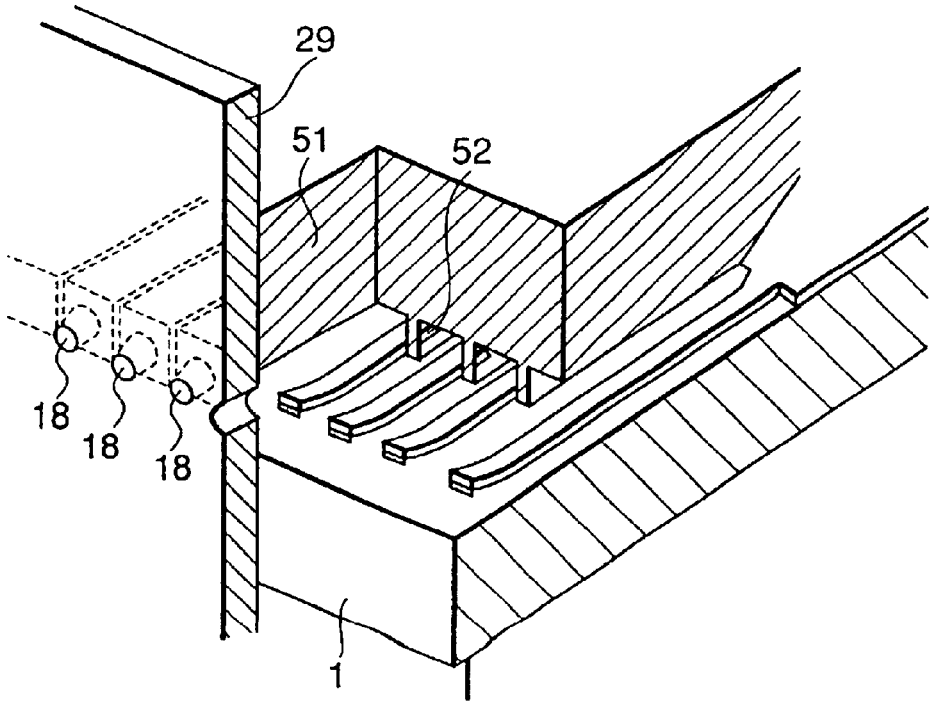

FIGS. 18A and 18B are views which illustrate the liquid discharge head manufactured by the method for manufacturing liquid discharge heads in accordance with one embodiment of the present invention; FIG. 18A is a cross-section view; and FIG. 18B is a partially broken perspective view.

As shown in FIGS. 18A and 18B, the present embodiment comprises the heat generating member 2 that creates bubbles by the application of heat; the substrate 1 on which the heat generating members 2 are incorporated; the discharge ports 18 for discharging liquid; the orifice plate 29 having the discharge ports 18 formed therefor to determine the discharge direction of liquid; liquid flow paths 10 for supplying the discharge liquid to each of the discharge ports 18; the grooved member 51 that forms each of the liquid flow paths 10; and the movable member 31 displaceable along the creation of bubbles on each of the heat generating members 2. Here, the groove walls 52 that separate a plurality of liquid flow paths 10 from each other are arranged to extend in the direction toward the orifice plate 29, and bonded to the orifice plate 29 by the application of bonding agent or the like. Now, the description will be made of a method for manufacturing liquid discharge heads in conjunction with FIGS. 19A to 19I.

Here, FIGS. 19A to 19I are views which illustrate the method for manufacturing the liquid discharge head represented in FIGS. 18A and 18B.

Figure 19A:
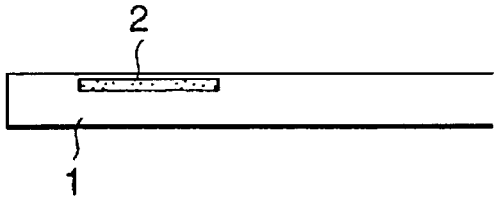
FIGS. 19A, 19B, 19C, 19D, 19E, 19F, 19G, 19H and 19I are views which illustrate the method for manufacturing liquid discharge heads in accordance with a sixth embodiment of the present invention.
Figure 19B:
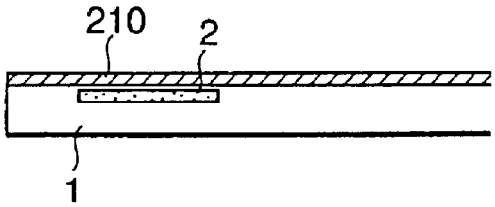

At first, on the surface of the substrate 1 having the heat generating member 2 arranged thereon (FIG. 19A), the electrode layer 210 formed by TiW layer or nickel layer is arranged by means of sputtering method or the like (FIG. 19B).

Figure 19C:
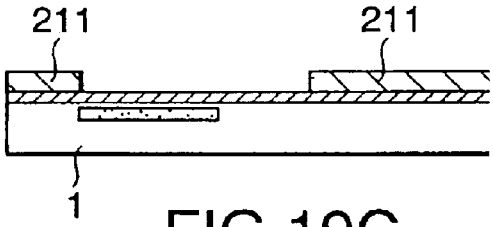

Then, the electrode layer 210 is coated by resist 214. After that, the resist 214 on the position corresponding to the movable portion of the movable member is patterned (FIG. 19C).

Figure 19D:
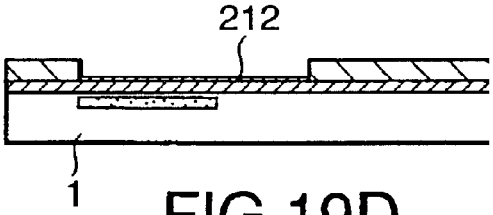

Then, on the position described above, an organic conductive film 212 is coated by means of dipping or the like in order to enhance the releasability between the electrode layer and the electroformed nickel to be exercised later (FIG. 19D).

Figure 19E:
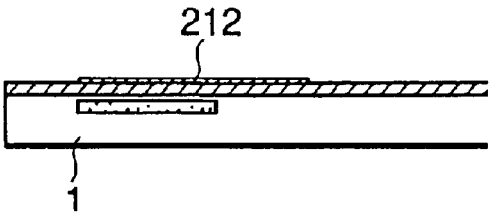
Figure 19F:
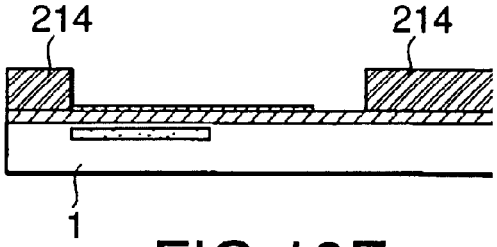

Subsequently, the resist 214 is removed (FIG. 19E). Then, the configuration of the movable member and the non-movable area of the movable member are again patterned with resist. In this case, the non-movable area is of course made wider than the area where the releasing agent has been applied.

Figure 19G:
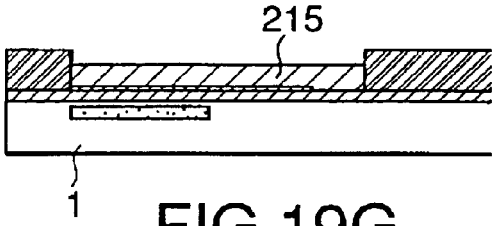

Then, the surface of the substrate 1 is coated with resist 215 (FIG. 19G).

Figure 19H:
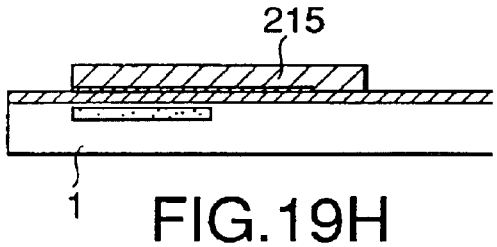

After that, the resist 214*r* is removed, and the movable member is formed with the supporting plate 4 made of nickel 215 (FIG. 19H).

Figure 19I:
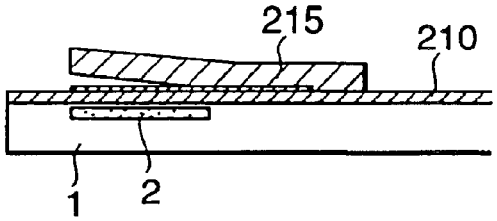

Subsequently, by the utilization of difference in the thermal expansion coefficient with the substrate 1, the nickel on the area where the releasable agent has been applied and the substrate 1 are separated by the application of heat (FIG. 19I).

In this respect, if the uppermost layer of the surface of the substrate 1 is made electrode, there is no need for the production of the electrode layer 210.

(Seventh Embodiment)

Now, in conjunction with FIGS. 20A to 20I, the description will be made of the method for manufacturing liquid discharge heads in accordance with a seventh embodiment of the present invention.

FIGS. 20A to 20I are views which illustrate each processing step of the method for manufacturing liquid discharge heads in accordance with the present embodiment. It is noted that each of processing steps shown in FIGS. 20A to 20I corresponds to each of them in FIGS. 19A to 19I.

Figure 20A:
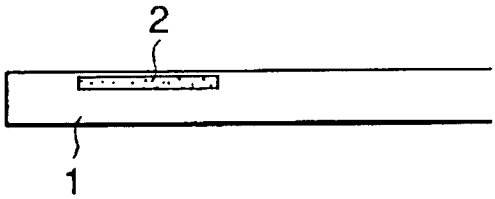
FIGS. 20A, 20B, 20C, 20D, 20E, 20F, 20G, 20H and 20I are views which illustrate the method for manufacturing liquid discharge heads in accordance with a seventh embodiment of the present invention.
Figure 20B:
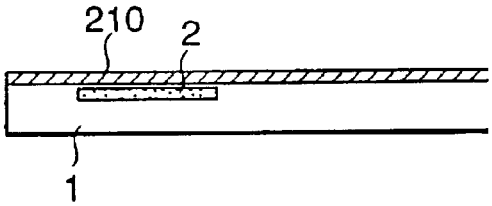
Figure 20C:
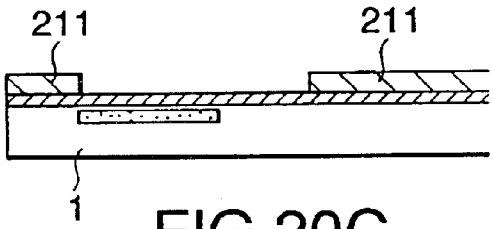
Figure 20D:
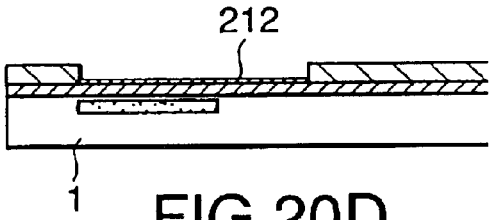
Figure 20E:
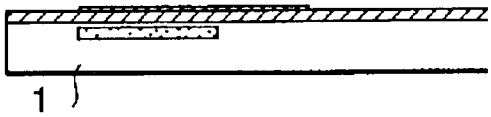

For the present embodiment, those processes up to the step shown in FIG. 20E are the same as those of the sixth embodiment.

Figure 20F:
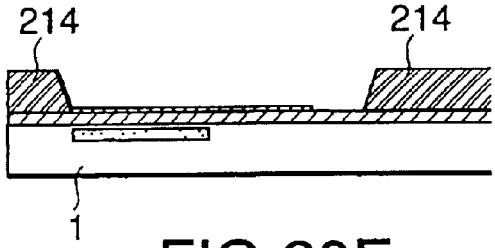

Then, the amount of exposure is adjusted with respect to the resist 214 used for the electroformation of nickel serving as the movable member so as to make the thickness of the gap on the substrate 1 side in the thickness direction of the resist 214, while making it wider on the surface side. In this manner, the exposure development is conducted (FIG. 20F).

Figure 20G:
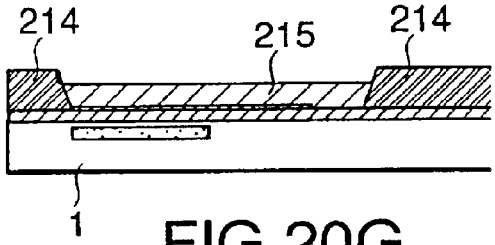
Figure 20H:
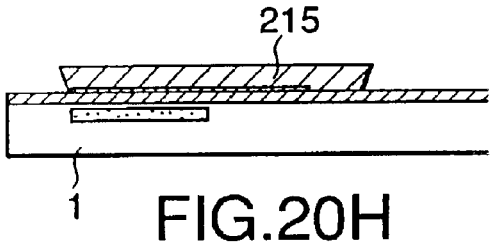

Subsequently, nickel is electroformed (FIG. 20G). Then, the resist 214 is removed to form the reverse side of the movable member larger than the surface thereof on the heat generating 2 side (FIG. 20H).

Figure 20I:
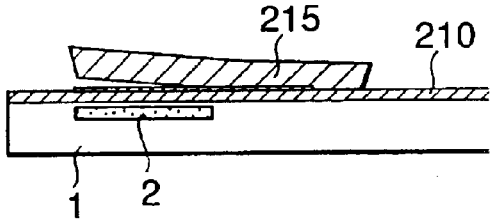

At last, the nickel 215 on the area where the releasing agent has been applied and the substrate 1 are separated from each other by giving heat, ultrasonic waves or vibrations or these combined to the movable member 215 and the substrate 1 (FIG. 20I).

In accordance with the present embodiment, it is made possible to use a jig to mechanically separate the movable member 215 and the substrate 1 with the movable member 215 having been configured as described above even if the movable member and substrate cannot be separated by means of heating, ultrasonic waves, or vibrations in the process shown in FIG. 20I. Thus, it is made possible to separate the movable portion of the movable member 215 from the substrate 1 reliably.

(Eighth Embodiment)

Figure 21:
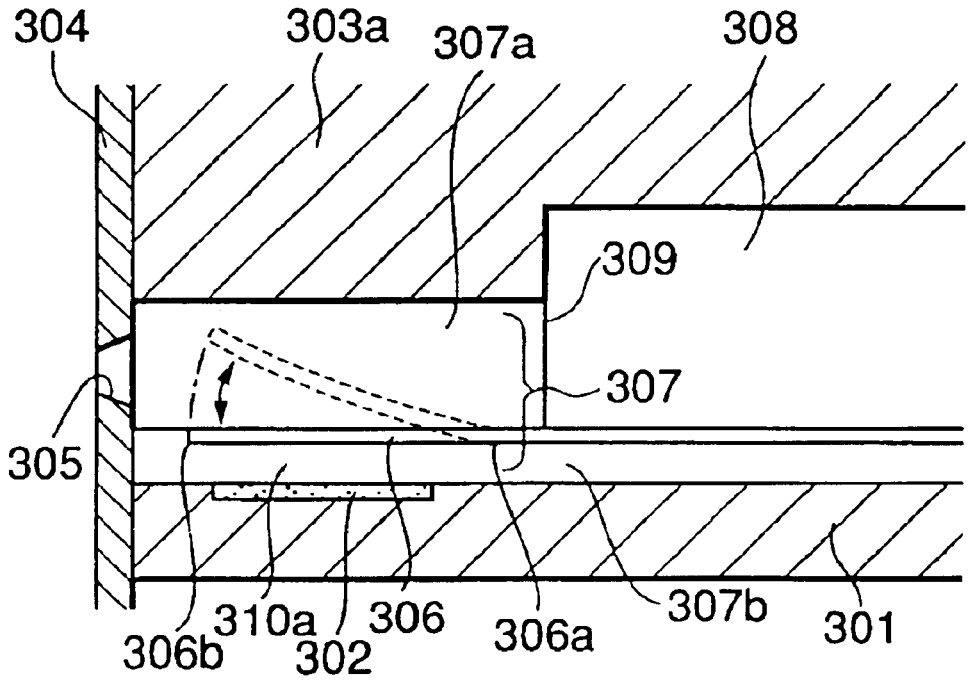
FIG. 21 is a cross-sectional view which illustrates the function of the liquid discharge head in accordance with the present invention.

FIG. 21 is a cross-sectional view which illustrates the fundamental structure of a liquid discharge head in accordance with the present invention, taken in the liquid flow direction.

Figure 22:
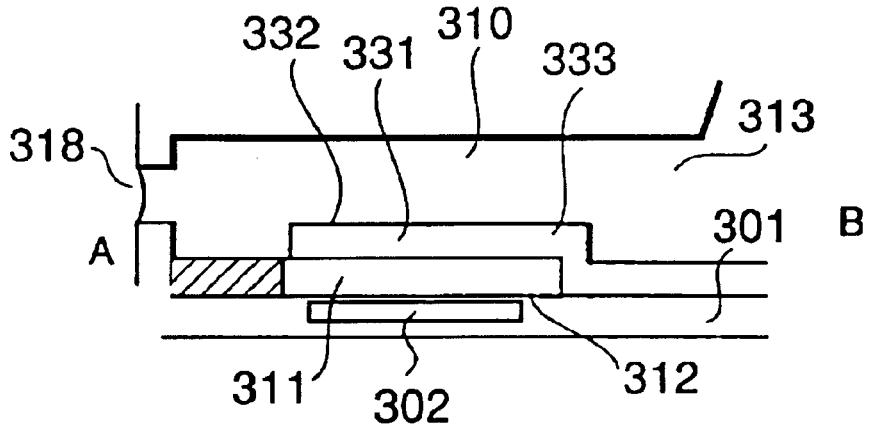
FIG. 22 is a cross-sectional view which shows the configuration of the movable member manufactured in the processes represented in FIGS. 20A to 20I.

As shown in FIG. 21, the liquid discharge head is provided with an elemental substrate 301 having a plurality of heat generating members 302 (in FIG. 22, only one is shown) arranged in series for giving thermal energy to create bubbles in liquid; a ceiling plate 303*a* to be bonded to the elemental substrate 301; and an orifice plate 304 joined to the front end of the elemental substrate 301 and the ceiling plate 303*a*.

For the elemental substrate 301, silicon oxide film or silicon nitride film is formed on a substrate made of silicon or the like for the purpose of insulation and heat accumulation. Then, patterning is given to it to provide the electric resistance layer and wiring for the formation of the heat generating member 2. When a voltage is applied to the electric resistance layer through the wiring, the electric current flows on the electric resistance layer to enable the heat generating member 2 to give heat.

The ceiling plate 303*a* forms a plurality of liquid flow paths 307 corresponding to each of the heat generating members 302, and the common liquid chamber 308 for supplying liquid to each of the liquid flow paths 307 as well. The side walls 309 of liquid paths are integrally provided for the ceiling plate, which extend between the heat generating members 2, respectively. The ceiling plate 303 is formed by silicon material to make it possible to form the liquid flow paths 307 and the common liquid chamber 309 by etching the respective patterns or form them by etching the liquid flow paths 307 portion after material, such as silicon nitride or silicon oxide, is deposited on the silicon substrate by means of the known film formation method, such as the CVD, so as to make it the side walls of the flow paths.

On the orifice plate 304, a plurality of discharge ports 305 are formed, which are communicated with each of the liquid flow paths 307 and the common liquid chamber 305 through each of the liquid flow paths 307 correspondingly. The orifice plate 304 is also formed by silicon material. For example, the orifice plate can be formed by cutting the silicon substrate having the discharge ports 305 formed therefor to a thickness of approximately 10 to 150 $\mu$m. Here, the orifice plate 304 is not necessarily the constituent required for the structure of the present invention. Instead of the provision of the orifice plate 304, it may be possible to provide a ceiling plate with discharge ports by leaving a portion equivalent to the thickness of the orifice plate 304 intact on the wall of the leading end of the ceiling plate 303*a* when the liquid flow paths 307 are formed on the ceiling plate 303*a*, and then, the discharge ports 305 are formed on this particular portion thus left intact.

Further, for the liquid discharge head, there is provided a movable member 306 of cantilever type arranged to face the heat generating member 302 in order to separate the liquid flow paths 307 into first liquid flow paths 307*a* and the second liquid flow paths 307*b* in which each of the heat generating members 302 is arranged, respectively. The movable member 306 is a thin film formed by silicon material, such as silicon nitride or silicon oxide.

The movable member 306 is arranged in a position to face the heat generating member 302 with a specific gap with it to cover the heat generating member 302 so that this member has the fulcrum 306*a* on the upstream side of the large flow made by the discharge operation of liquid from the common liquid chamber 308 to the discharge port 305 side through the movable member 306, and also, the free end 306*b* on the downstream side with respect to this fulcrum 306*a*. There is the bubble generating area 310*a* between the heat generating member 302 and the movable member 306.

With the structure arranged as above, when the heat generating member 302 is energized, heat acts upon the liquid that resides on the bubble generating area 310*a* between the movable member 306 and the heat generating member 302, thus creating and developing bubble on the heat generating member 302 by means of film boiling phenomenon. The pressure exerted along with the development of the bubble acts upon the movable member 306 priorly. Then, as indicated by broken lines in FIG. 21, the movable member 306 is displaced to open widely to the discharge port 305 side with the fulcrum 306*a* as its center. By the displacement of the movable member 306 or the displacing condition thereof, the propagation of the pressure exerted by the creation of bubble and the development of the bubble itself are carried to the discharge port 305 side. In this manner, liquid is discharged from the discharge port 305.

In other words, with the provision of the movable member 306 on the bubble generating area 310*a*, which has its fulcrum 306*a* on the upstream side (on the common liquid chamber 308 side) of the liquid flow in the liquid flow path 307 and its free end 306*b* on the downstream side (on the discharge port 305 side), the pressure propagating direction of bubble is carried to the downstream side. Hence, the pressure of the bubble contributes directly to the discharge of liquid efficiently. Then, the development direction of bubble itself is also carried to the downstream side as the propagating direction of the pressure so as to enable the bubble to be developed larger on the downstream side than the upstream side. In this manner, the development direction of the bubble itself is controlled by means of the movable member, and the propagating direction of the bubble, as well. As a result, it becomes possible to enhance the fundamental discharge characteristics, such as the discharge efficiency and the discharge speeds, significantly.

On the other hand, when the bubble enters the disappearance process, it disappears rapidly by the synergic effect with the elasticity of the movable member 306. Then, the movable member 306 returns lastly to the initial position indicated by solid lines in FIG. 21. At this juncture, liquid flows in from the upstream side, namely, from the common liquid chamber to complement the contracted volume of the bubble on the bubble generating area 310*a* or to complement the voluminal portion of the liquid that has been discharged. In this way, liquid is refilled in the liquid flow path 307. This liquid refilling is carried out rationally and stably along with the returning action of the movable member 306 efficiently.

Now, hereunder, the detailed description will be made of the materials that form the movable member which is characteristic of the liquid discharge head of the present invention, and the method of manufacture therefor as well.

Figure 23A:
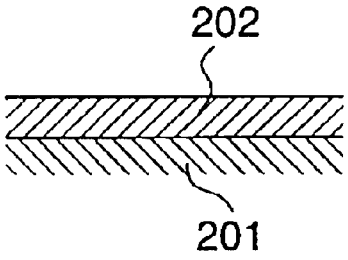
FIGS. 23A, 23B, 23C, 23D, 23E, 23F, 23G and 23H are views which illustrate a method for manufacturing a movable member used for the liquid discharge head of the present invention in accordance with an eighth embodiment thereof.

At first, BPSG is formed on the substrate 201 by means of the CVD method at a temperature of 350° C. (FIG. 23A). The film thickness of this BPSG is eventually equivalent to the gap between the movable portion of the movable member and the heat generating member, and such thickness is controlled to be at an optimal value between 1 μm and 20 μm where the movable member demonstrates its effect most remarkably in consideration of the entire balance of the flow paths. Subsequently, resist 203 is applied by means of spin coating or the like in order to pattern the BPSG (FIG. 23B), and then, exposed and developed (FIG. 23C), thus removing the resist on the portion corresponding to the fixed portion of the movable member.

Figure 23E:
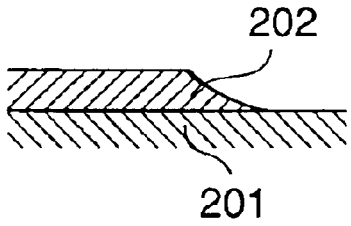
Figure 23B:
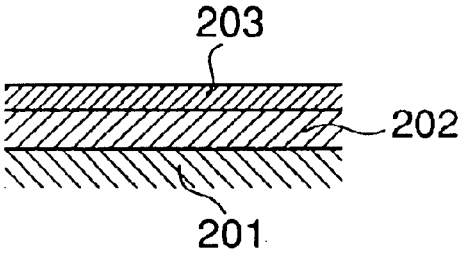
Figure 23F:
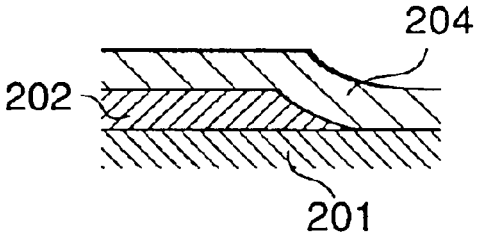
Figure 23C:
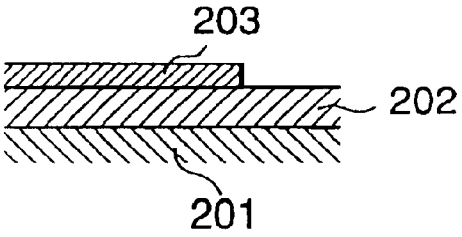
Figure 23G:
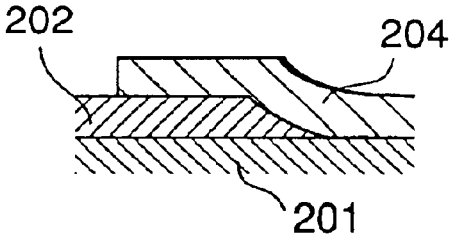
Figure 23D:
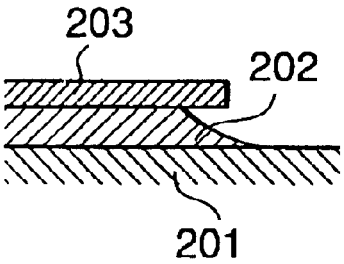

Then, the BPSG having no resist thereon is removed by means of wet etching with buffered hydrofluoric acid. After that, the remaining resist is removed by applying to it the plasma ashing using oxygen plasma or by dipping it in the resist removal solution (FIG. 23E). Then, SiN film is formed on the BPSG in a thickness of 1 to 10 μm (here, the best composition of the SiN film is $Si_3N_4$, but there is no problem if N is in a range of 1 to 1.5 with respect to the Si:1 to obtain the anticipated effect of the movable member) by the performance of plasma CVD with ammonia and silane gas at a temperature of 400° C. The SiN film is generally used for the semiconductor process, and this film has resistance to alkali and presents chemical stability, and also, it has resistance to ink.

In other words, since this film becomes the movable member ultimately, there is no particular restriction on the method of manufacture whereby to attain the composition and structure in order to obtain the optimal value of material. For example, as to the formation method of SiN, it is possible to adopt not only the plasma CVD as described earlier, but also, to use the atmospheric CVD, LP (low pressure) CVD, biased ECRCVD, microwave CVD, or sputtering or coating for its formation. Also, it may be possible to change the composition factors of the SiN film step by step to make it a multi-layered film in order to enhance its stress, rigidity, Young's modulus, and other physical properties, as well as resistance to alkali, acid resistance, and other chemical properties, or the film is made multi-layered by adding impurities step by step or it may be possible to add impurities to a single layer. Then, resist is applied by spin coating in order to pattern the SiN film. After patterning, the configuration of the movable member is etched by dry etching, reactive ion etching, or the like using $CF_4$ gas or the like.

Figure 23H:
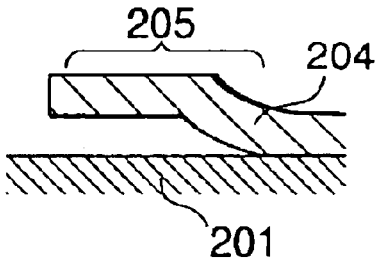

Lastly, all the BPSG remaining on the lower part of the movable portion is removed by the wet etching that uses buffered hydrofluoric acid. Than, as shown in FIG. 23H, the movable member is formed. Here, if BPSG should remain partly as the residue of etching in the deepest part of the lower part of the movable portion, the BPSG is easily etched by alkali such as ink. As a result, it can be dissolved out eventually when ink is supplied, and there is no problem that easily arises as any that may directly affect the reliability of the member. Here, also, for the provision of the gap required for the movable member, it should be good enough if only the selection ratio with SiN is obtainable by the application of buffered hydrofluoric acid, not necessarily by the BPSG as described above. Therefore, aside from the BPSG, the SiO film may be adoptable if it is easily etched at a lower temperature, such as 400° C. or less or it may be possible to use PSG with only P being added. Also, besides those mentioned above, it may be possible to use an organic material from the viewpoint of easier process.

In this respect, the thickness of the movable member is regulated to be 1 to 10 μm as described above. However, it is possible to obtain the same effect even if the relative thickness of the SiN is made ½ of the Ni of the movable member which is known publicly, for example, because its Young's modulus is higher approximately two times.

Here, the above description has been made only of the movable member, but the supporting portion of the movable member may be made together at a time, but the effect of the present invention is not affected at all, either, even if the supporting portion is formed by different material in order to make its close contact or the method of manufacture simpler.

(Variational Example)

It may be possible to form the movable member with diamond film or amorphous carbon hydride film. In accordance with the present embodiment, it is possible to form the diamond film, instead of the SiN film, if plasma is pumped at the substrate temperature of 450° C. by use of microwaves (2.45 GHz) with methane gas, nitrogen, oxygen as its material or form the amorphous carbon hydride film (diamond like carbon), which can be produced more easily than diamond, by the plasma CVD method in which plasma is pumped by the RF bias of 13.56 MHz.

The diamond film thus formed is excellent in its physical properties (for example, its Young's modulus is approximately three times SiN, and relatively, the same effect is still obtainable in a thickness of ⅓). Its chemical stability is also high, while having an excellent heat radiation. Therefore, this film is more suitable for the movable member than SiN film. Also, the amorphous carbon hydride film is better than the SiN film, although it is inferior to the diamond film in the physical properties. Consequently, from the viewpoint of the balance in costs of manufacture, that is, performance and difficulty in its manufacture, the amorphous carbon hydride film is also usable in place of the diamond film or the SiN film.

Also, the same effect is obtainable with the movable member being formed by SiC. The best composition of the SiC film is Si:C=1:1. As the material for the movable member, the same effect is still obtainable by C being in a range of 0.5 to 1.5.

Now, hereunder, the description will be made of the structure of the elemental substrate 1 having the heat generating member 2 arranged therefor to give heat to liquid.

Figure 15A:
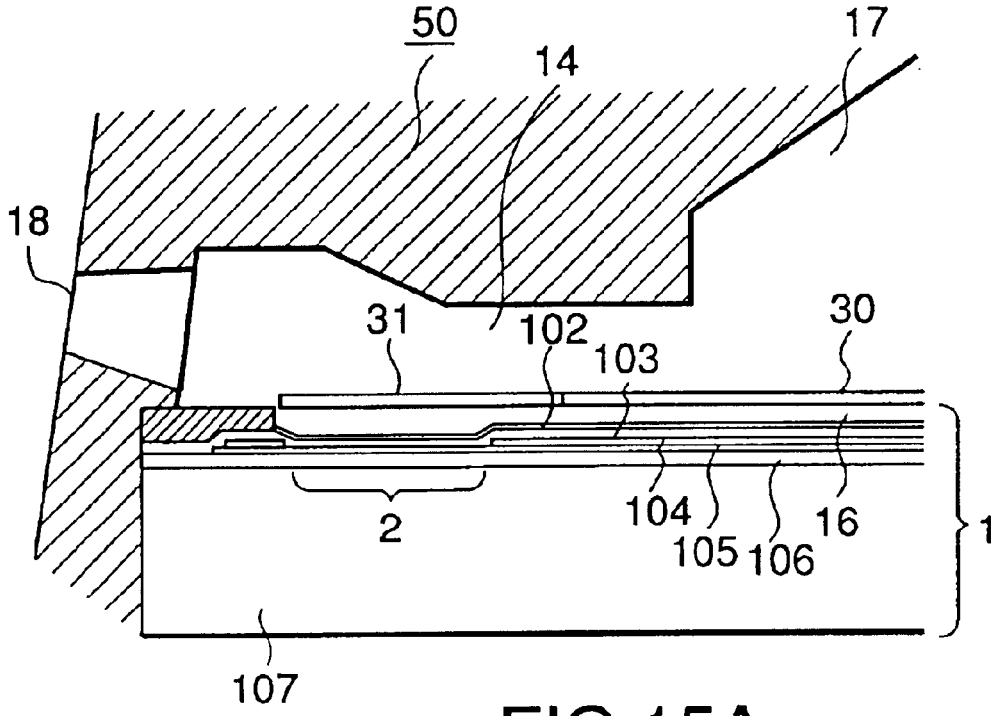
FIGS. 15A and 15B are vertically sectional views which illustrate one structural example of the liquid jet apparatus to which the liquid discharge head of the present invention is applicable.
Figure 15B:
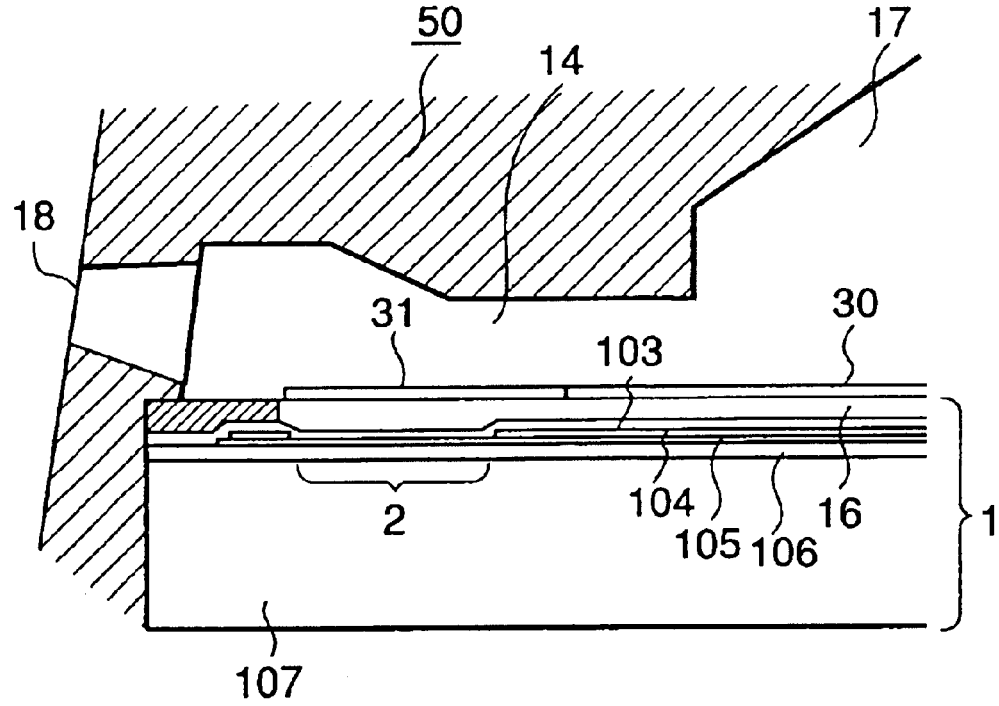

FIGS. 15A and 15B are vertically sectional views which illustrate one structural example of the liquid jet apparatus to which the liquid discharge head of the present invention is applicable; FIG. 15A shows the apparatus having a protection film to be described later; and FIG. 15B shows the apparatus which is not provided any protection film.

In FIGS. 15A and 15B, the liquid flow path designated by a reference numeral 10 in FIGS. 1A to 1D is designated as the first liquid flow path 14. Also, the liquid supply path designated by a reference numeral 12 is designated as the second liquid flow path 16. It may be possible to supply the same liquid to each of the liquid flow paths, but if different liquids may be made usable, the selection range becomes wider for the liquids to be supplied to the first liquid flow path, that is, such range is made wider for the selection of discharge liquids.

As shown in FIGS. 15A and 15B, there is arranged on the elemental substrate 1, a grooved member 50 having grooves that constitute the second liquid flow path 16, separation walls 30, movable member 31, and first liquid flow path 14.

On the elemental substrate 1, a silicon oxide film or a silicon nitride film 106 is formed on the substrate 107 of silicon or the like for the purpose of insulation and heat accumulation. On such film, there are patterned, an electric resistance layer 105 of hafnium boride ($HfB_2$), tantalum nitride (TaN), tantalum aluminum (TaAl) or the like, which forms a heat generating member in a thickness of 0.01 to 0.2 $\mu$m, and wiring electrodes 104 of aluminum or the like in a thickness of 0.2 to 1.0 $\mu$m. Then, a voltage is applied to the electric resistance layer 105 from the two wiring electrodes 104 to cause electric current to run for generating heat. On the electric resistance layer 105 across the wiring electrodes 104, a protection layer 103 of silicon oxide, silicon nitride, or the like is formed in a thickness of 0.1 to 0.2 $\mu$m. Further on it, an anti-cavitation layer 102 of tantalum or the like is formed in a thickness of 0.1 to 0.6 $\mu$m, hence protecting the electric resistance layer 105 from ink or various other kinds of liquids.

The pressure and shock waves are extremely strong, particularly when each of the bubbles is foamed or defoamed. The durability of the oxide film, which is hard but brittle, tends to be degraded considerably. Therefore, tantalum (Ta) or other metallic material is used as the anti-cavitation layer 102.

Also, there may be adoptable a structure that does not use any protection layer described above just by arranging an appropriate combination of the liquid, the liquid flow structure, and the resistive material. Such example is shown in FIG. 15B.

As the material used for the resistance layer that does not require any protection layer, an alloy of iridium-tantalum-aluminum is adoptable. Now that the present invention makes it possible to separate the liquid for foaming use from the discharge liquid, it presents its particular advantage when no protection layer is adopted in a case like this.

As described above, the structure of the heat generating member 2 adopted for the present embodiment may be provided only with the electric resistance layer 105 (heat generating portion) across the wiring electrodes 104 or may be arranged to include a protection layer to protect the electric resistance layer.

In accordance with the present embodiment, the heat generating member 2, which is adopted therefor, is provided with the heat generating portion formed by the resistance layer that generates heat in accordance with electric signals. The present invention is not necessarily limited to such device. It should be good enough if only the device can create each bubble in the foam liquid, which is capable enough to discharge the liquid for discharging use. For example, there may be a heat generating member provided with the photothermal transducing unit as the heat generating portion that generates heat when receiving laser or other light beams or provided with a heat generating portion that generates heat when receiving high frequency.

In this respect, on the elemental substrate 1 described earlier, there may be incorporated functional devices integrally by the semiconductor manufacturing processes, such as transistors, didoes, latches, shift registers, which are needed for selectively driving the electrothermal transducing devices, besides each of the electrothermal transducing devices, which is structured by the electric resistance layer 105 that forms the heat generating portion, and wiring electrodes 104 that supply electric signals to the electric resistance layer 105.

Also, it may be possible to drive the heat generating portion of each electrothermal transducing device arranged on the elemental substrate 1 described above so as to apply rectangular pulses to the electric resistance layer 105 through the wiring electrodes 104 to cause the layer between the electrodes to generate heat abruptly for discharging liquid.

Figure 16:
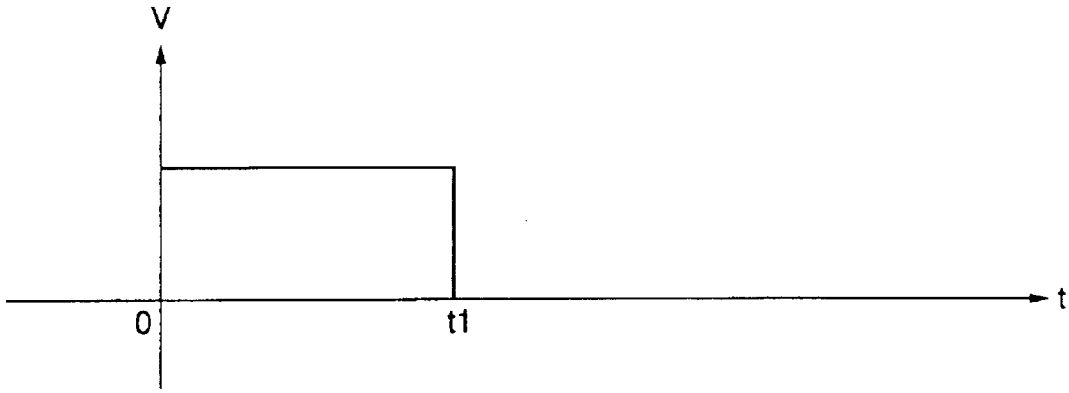
FIG. 16 is a view which shows the waveform of a voltage applied to the electric resistance layer presented in FIGS. 15A and 15B.

FIG. 16 is a view which shows the voltage waveform to be applied to the electric resistance layer 105 represented in FIGS. 15A and 15B.

For the liquid jet apparatus of the embodiment described above, the electric signal of 6 kHz is applied at a voltage 24V with the pulse width of 7 $\mu$sec, and at the electric current of 150 mA to drive each heat generating member. With the operation described earlier, ink serving as liquid is discharged from each of the discharge ports. However, the present invention is not necessarily limited to these conditions of driving signal. It may be possible to apply the driving signals under any condition if only such signals can act upon the foam liquid to foam appropriately.

Now, hereunder, the description will be made of the structural example of a liquid jet apparatus provided with two common liquid chambers, but its part numbers are reduced. Here, different kinds of liquids are retained in each of the common liquid chambers by separating them in good condition, which makes the remarkable cost reduction possible.

Figure 17:
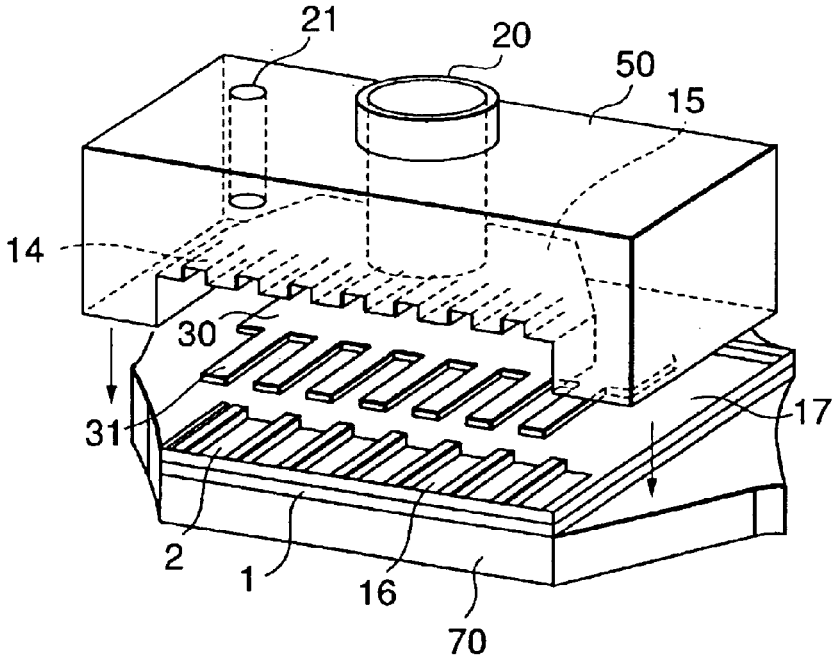
FIG. 17 is an exploded perspective view which shows one structural example of the liquid jet apparatus to which the liquid discharge head of the present invention is applicable.

FIG. 17 is an exploded perspective view which shows one structural example of the liquid jet apparatus to which the liquid discharge head of the present invention is applicable.

In accordance with the present embodiment, an elemental substrate 1 is arranged on a supporting member 70 made of aluminum or other metal. As described earlier, on the substrate, a plurality of electrothermal transducing devices serving as the heat generating members 2 are arranged for generating heat to create bubbles by means of film boiling in foaming liquid.

There are provided on the elemental substrate 1, a plurality of grooves formed by DF dry film, which constitute the second liquid flow paths 16; a recessed portion communicated with the plural second liquid flow paths 16 and forms a second common liquid chamber (common foaming liquid chamber) 17 to supply foaming liquid to each of the second liquid flow paths 16; and the separation walls 30 having the movable members 31 bonded thereto as described earlier.

The grooved member 50 is provided with grooves that constitute first liquid flow paths (discharge liquid flow paths) 14 when it is bonded to the separation walls 30; a recessed portion that forms the first common liquid chamber (common discharge liquid chamber) 15 to supply discharge liquid to each of the first liquid flow paths 14; the first liquid supply path (discharge liquid supply path) 20 to supply discharge liquid to the first common liquid chamber 15; and the second liquid supply path (foaming liquid supply path) 21 to supply foaming liquid to the second common liquid chamber 17. The second liquid supply path 21 penetrates the movable members 31 arranged outside the first common liquid chamber 15 and the separation walls 30 to be connected with the conductive path which is communicated with the second common liquid chamber 17. Through this conductive path, the foaming liquid is supplied to the second common liquid chamber 17 without being mixed with the discharge liquid.

In this respect, the arrangement relationship between the elemental substrate 1, movable members 31, separation walls 30, and grooved member 50 is such that the movable members 31 are arranged corresponding to the heat generating members 2 on the elemental substrate 1, and then, the first liquid flow paths 14 are arranged corresponding to the movable members 31. Also, in accordance with the present embodiment, the description has been made of the example in which the second liquid supply path 21 is arranged for one grooved member 50, but a plurality of them may be arranged depending on the amount of liquid supply. Further, the sectional areas of the first liquid supply path 20 and second liquid supply path 21 may be determined in proportion to the amount of supplies. To optimize the sectional areas of liquid flow paths makes it possible to implement making the parts that constitute the grooved member 50 and others smaller still.

As described above, in accordance with the present invention, the movable portion of each movable member is separated from the substrate after each movable member is formed on it. In this way, the movable members are incorporated in a liquid discharge head. As a result, there is no need for positioning the movable members to the substrate, hence implementing the arrangement of more precise interior of each liquid flow path.

In this way, it becomes possible to materialize a liquid discharge head in higher precision. Also, in accordance with the present invention, the movable members are incorporated on the substrate formed by a material having resistance to ink. Therefore, not only the movable members that face each of the bubble generating areas are utilized for discharging liquid by guiding bubbles created on the bubble generating area efficiently, but also, the movable members can be manufactured easily. Thus, it is possible to provide a highly reliable liquid discharge head and the substrate for use of such liquid discharge head as well.

What is claimed is:

1. A substrate for use in a liquid discharge head, said substrate being provided with a heat generating member for creating a bubble in the liquid, and a cantilever type movable member arranged to face said heat generating member with a specific gap therebetween, wherein said movable member is fixed to said substrate and is formed from a material comprising any one of silicon nitride, diamond, amorphous carbon hydride, silicon carbide, and silicon oxide, and wherein said movable member is provided with a portion integrated with said substrate and fixed on said substrate by laminating said material from which said movable member is formed, a curved portion curving with respect to said substrate, and a movable portion separated from said substrate at a tip of said curved portion.

2. A liquid discharge head having a substrate according to claim 1, comprising:

a discharge port for discharging liquid; and a liquid flow path communicating with said discharge port to supply the liquid to said discharge port, wherein said movable member is arranged in said liquid flow path, said movable member having a free end on a discharge port side to face said heat generating member, and said free end being positioned downstream of an area center of said heat generating member.

3. A liquid discharge head according to claim 2, wherein said movable member is formed by silicon nitride with impurities being added thereto.

4. A liquid discharge head according to claim 1, wherein said movable member is formed by a silicon nitride multi-layered film with the composition thereof being changed or impurities being added thereto.

5. A substrate for use in a liquid discharge head according to claim 1, wherein said movable member is formed by silicon nitride with impurities being added thereto.

6. A substrate for use in a liquid discharge head, said substrate being provided with a heat generating member for creating a bubble in the liquid, and a cantilever type movable member arranged to face said heat generating member with a specific gap therebetween, said movable member being fixed to said substrate and being formed by a silicon nitride multi-layered film with the composition thereof being changed or impurities being added thereto.

7. A method for manufacturing a substrate for use in a liquid discharge head, comprising the steps of providing the substrate with a heat generating member for generating a bubble in the liquid, and with a cantilever type movable member arranged to face said heat generating member with a predetermined gap therebetween, wherein said movable member is provided on said substrate by a photolithographic method, and wherein said movable member is provided with a portion integrated with said substrate and fixed on said substrate by laminating a material from which said movable member is formed, a curved portion curving with respect to said substrate, and a movable portion separated from said substrate at a tip of said curved portion.

8. A method for manufacturing a substrate for use in a liquid discharge head according to claim 7, wherein the movable member is formed by any one of silicon nitride, diamond, amorphous carbon hydride, silicon carbide, or silicon oxide.

9. A liquid discharge head, comprising:

a plurality of discharge ports for discharging liquid;

a plurality of liquid flow paths respectively communicating with said discharge ports to supply liquid to said discharge ports;

a substrate provided with heat generating members for creating a bubble in the liquid;

movable members arranged in said plural liquid flow paths, respectively, said movable members each having a free end on a discharge port side to face a respective one of said heat generating members; and a pedestal portion formed on said substrate for supporting said movable members, wherein each of said movable members is formed by laminating a material on said substrate and delaminating the material from said substrate, a thermal expansion coefficient of a portion of the laminated material facing said substrate being higher than that of another portion of the laminated material.

10. A liquid discharge head according to claim 9, wherein said movable member has a property of being curved by heat.

11. A liquid discharge head according to claim 9, wherein a portion of said movable member corresponding to a movable range of said movable member is separated from said substrate by means of an inner stress of said movable member and a function of a releasable layer formed on said substrate.

* * * * *

UNITED STATES PATENT AND TRADEMARK OFFICE

CERTIFICATE OF CORRECTION

PATENT NO. : 6,834,943 B2
DATED : December 28, 2004
INVENTOR(S) : Hiroaki Mihara et al.

It is certified that error appears in the above-identified patent and that said Letters Patent is hereby corrected as shown below:

Column 1,
Line 43, “noises.” should read -- noise. --.

Column 3,
Line 37, “either one of” should read -- of any one of --.
Line 38, “being” should read -- is --.
Line 51, “expression” should read -- expressions --.
Line 57, “droplet” should read -- a droplet --.

Column 6,
Line 17, “resign” should read -- resist --.

Column 8,
Line 9, “electrode,” should read -- to serve as an electrode, --.
Line 19, “is formed” should read -- formed --.
Line 52, “each” should be deleted.

Column 9,
Line 45, “electrode,” should read -- to serve as an electrode, --.

Column 10,
Line 40, “electrode,” should read -- to serve as an electrode, --.

Column 11,
Line 28, “only” should read -- only on --.
Line 47, “electrode,” should read -- to serve as an electrode, --.

Column 12,
Line 14, “only” should read -- only on --.
Line 42, “along” should read -- with --.

Column 13,
Line 8, “**214*r*” should read -- 214** --.
Line 17, “electrode,” should read -- to serve as an electrode, --.

Column 16,
Line 45, “higher approximately two times” should read -- approximately two times higher --.
Line 48, “at a time,” should read -- at the same time, --.

UNITED STATES PATENT AND TRADEMARK OFFICE

CERTIFICATE OF CORRECTION

PATENT NO. : 6,834,943 B2
DATED : December 28, 2004
INVENTOR(S) : Hiroaki Mihara et al.

It is certified that error appears in the above-identified patent and that said Letters Patent is hereby corrected as shown below:

Column 18,
Line 27, “didoes” should read -- diodes --.

Column 19,
Line 6, “nicated” should read -- nicating --, and “forms” should read -- forming --.
Line 42, “supplies.” should read -- liquid supply. --.
Line 54, “materialize” should read -- realize --.

Signed and Sealed this

Twenty-second Day of November, 2005

JON W. DUDAS
*Director of the United States Patent and Trademark Office*